United States Patent [19]

Tsuchida et al.

[11] Patent Number: 4,893,884

[45] Date of Patent: Jan. 16, 1990

[54] WALL CABINET

[75] Inventors: Shigeki Tsuchida, Kusatsu; Sabarou Sumi, Omihachiman; Motohiro Nakagawa, Ikoma, all of Japan

[73] Assignees: Itoki Co., Ltd.; Itoki Kosakusho Co., Ltd., both of Osaka, Japan

[21] Appl. No.: 302,526

[22] Filed: Jan. 27, 1989

[51] Int. Cl.[4] ..... A47B 77/00

[52] U.S. Cl. ..... 312/107; 312/107.5; 312/254; 312/245

[58] Field of Search ..... 312/253, 254, 249, 245, 312/247, 107.5, 219, 220, 221, 107

[56] References Cited

U.S. PATENT DOCUMENTS

| | | | |
|---|---|---|---|
| 410,378 | 9/1889 | Rodeheaver | 312/219 |
| 3,175,872 | 3/1965 | Sullivan | 312/107.5 |
| 3,491,977 | 1/1970 | Iller | 312/245 X |
| 3,598,462 | 8/1977 | Kanitz | 312/219 |
| 3,767,280 | 10/1973 | McLaughlin | 312/219 |
| 3,828,937 | 8/1974 | Nash | 312/253 |
| 4,042,287 | 8/1977 | Hallen | 312/254 |

*Primary Examiner*—Joseph Falk

*Attorney, Agent, or Firm*—Armstrong, Nikaido Marmelstein Kubovcik & Murray

[57] ABSTRACT

A wall cabinet provided with an upper dividing member and a lower pedestal adjustable of height each on a container part constituted of various cabinets tall enough to reach a ceiling surface from a room floor surface, and installed at the central or other portions in a room to partition the room properly. Further provided is an all locking device capable of locking the cabinets constituting the container part of the wall cabinet all at once.

10 Claims, 28 Drawing Sheets

WALL CABINET

BACKGROUND OF THE INVENTION

1. Field of the Invention

The present invention relates to a wall cabinet, and is particularly concerned with an improvement of wall cabinets wherein cabinets tall enough to reach a ceiling surface from a floor surface in the room are installed at suitable portions such as the center and others of the room to screen off the room or provided upright along a wall surface of the room.

2. Description of the Prior Art

The prevalent room arrangement is such that cabinets tall enough to reach a ceiling surface from a floor surface in the room are installed along a wall surface of the room to use the overall wall surface effectively as a containable space, or the cabinets are provided at suitable portions such as the center and others of the room to form a containable space and also to screen off the room. In such cabinets, a containable space is secured effectively much in the room, and for preventing the cabinets from being turned slantingly or upside down, the cabinets are constructed so as to reach a ceiling surface from a floor surface and also installed to stretch against the floor surface and the ceiling surface. In such prior art cabinets, a lower end of the cabinet is placed on an underframe of constant height, a top frame divided vertically is mounted in a gap space between an upper end surface of the cabinet and the ceiling surface, the gap is filled up by expanding the upper and lower top frames, and then the top frame is fixed to stretch against the ceiling surface.

SUMMARY OF THE INVENTION

The invention relates to an improvement of the aforementioned wall cabinet, and in a wall cabinet wherein cabinets reaching a ceiling surface from a floor surface are installed along the room wall surface to form much containable space, or the cabinets are installed at suitable portions such as the center and others in the room to screen off the room, the invention is to provide some improvement wherein a containable space is effectively formed in the room, a gap between an upper end surface of the cabinet and the ceiling surface is filled up at a top of the cabinet, the cabinet is prevented from turning slantingly or upside down by stretching against the ceiling surface, then at a lower portion of the cabinet, it is installed on a pedestal adjustable vertically, and thus where, for example, a plurality of cabinets are provided laterally, lower end portions of the cabinets are aligned to a nice external appearance regardless of a tongued-and-grooved face of the floor, and the cabinets can be installed simply and securely.

Further, the invention is to provide an all-lock device capable of locking cabinets constituting a container part of the wall cabinet as described all at once.

DESCRIPTION OF THE INVENTION

Figure 1:
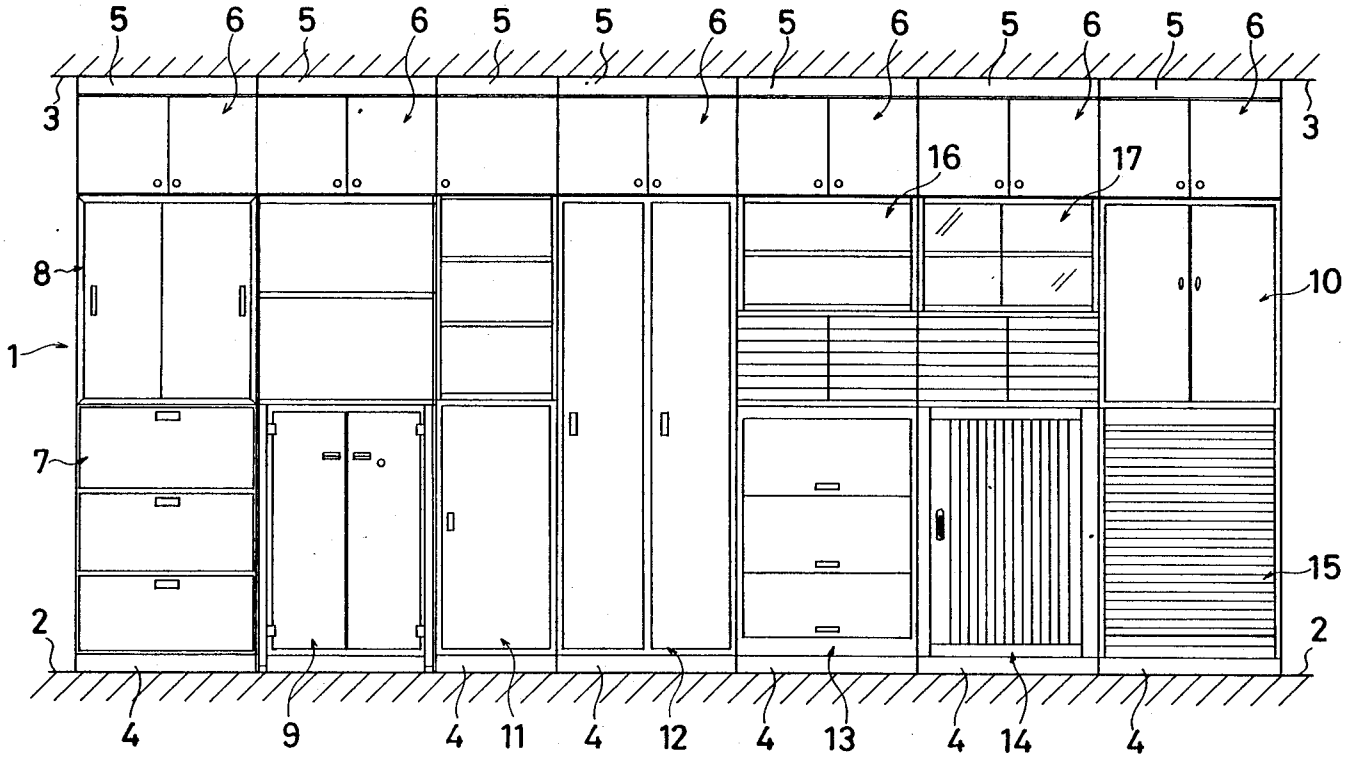
FIG. 1 is a front view of a wall cabinet given in one embodiment of the invention.

The invention will now be described in detail with reference to the accompanying drawings. As shown in FIG. 1, a wall cabinet relating to the invention comprises coupling and fixing lower pedestals 4 provided on a floor surface 2 and adjustable of a height between the floor surface 2 and a lower end surface of cabinets on a lower portion of various cabinets tall to almost reach a ceiling surface 3 from the floor surface 2 in the room which work as a container part 1, and also coupling and fixing upper dividing members 5 adjustable of a vertical move to the cabinets as fitted between the ceiling surface 3 and a top of the cabinets on an upper portion of the container part 1. Then, as shown also in FIG. 1, upper shelves 6 . . . of a height are provided on an upper portion of the container part 1 full lengthwise in a cross direction of the container part 1, a drawer cabinet 7, a slide cabinet 8 or a heavyweight thing such as safe 9 or the like are incorporated as a base, as illustrated, thereunder, and various cabinets such as double-hinged cabinet 10, single-hinged cabinet 11, locker cabinet 12, drawer type door cabinet 13, shutter door cabinets 14, 15, normal open shelf 16, shelf 17 provided with a glass slide door and the like can be built therein.

Those with a height capable of being fitted between various cabinets and the ceiling surface 3 will be selected for the upper shelves 6 . . . provided widthwise of the container part 1 of the wall cabinet according to a height from the floor surface 2 to the ceiling surface 3 of the room in which the wall cabinet is installed, and thus an overall height of the wall cabinet is adjustable to installation correspondingly to various sizes of room space. That is, when the height from the floor surface 2 to the ceiling surface 3 is big, a tall one is used as the upper shelf 6, but when it is not big, the shelf may be omitted. Further, in the invention, the construction comprises providing height adjusting means consisting of the upper dividing member 5 and the lower pedestal 4 on top and bottom of the container part 1 as described, therefore the wall cabinet can be installed securely in the room space.

Figure 3:
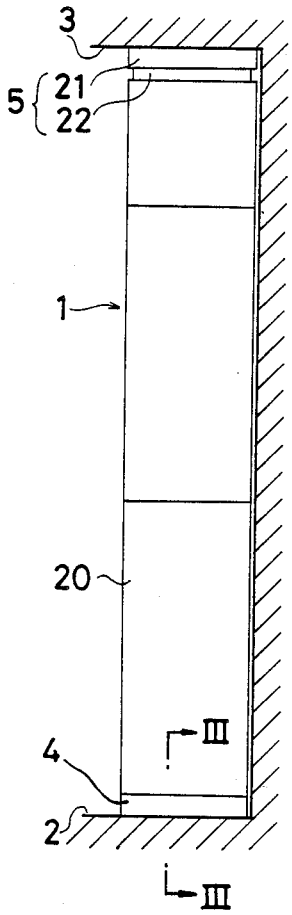
FIG. 3 is a right side view of FIG. 2.
Figure 2:
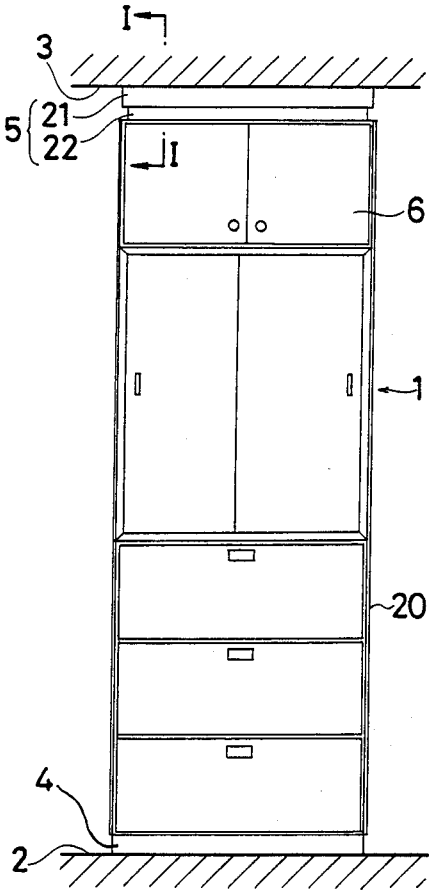
FIG. 2 is a fragmentary front view of the wall cabinet.

As described above, for the container part 1 consisting of various cabinets, upper and lower top frames 21, 22 constituting the upper dividing member 5 are arranged adjustably of the height on the top of a body 20 of the cabinet constituting the container part 1 (or on the top of the aforementioned upper shelf 6), and an underframe 23 constituting the lower pedestal is also arranged adjustably of the height on the bottom of the cabinet body 20, as shown in FIG. 2 or FIG. 3.

Figure 4:
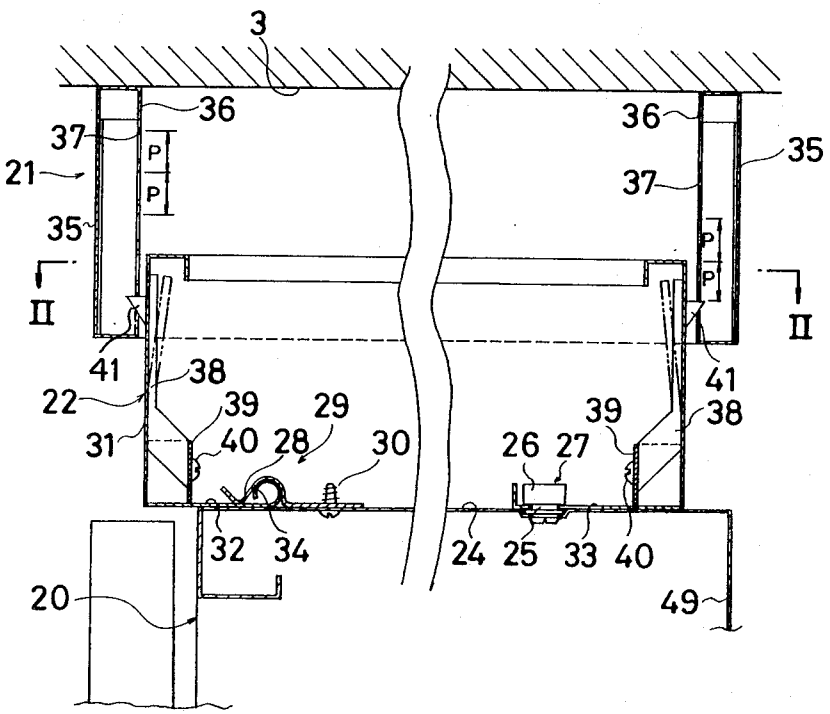
FIG. 4 is an enlarged sectional view taken on line I—I of FIG. 2.
Figure 5:
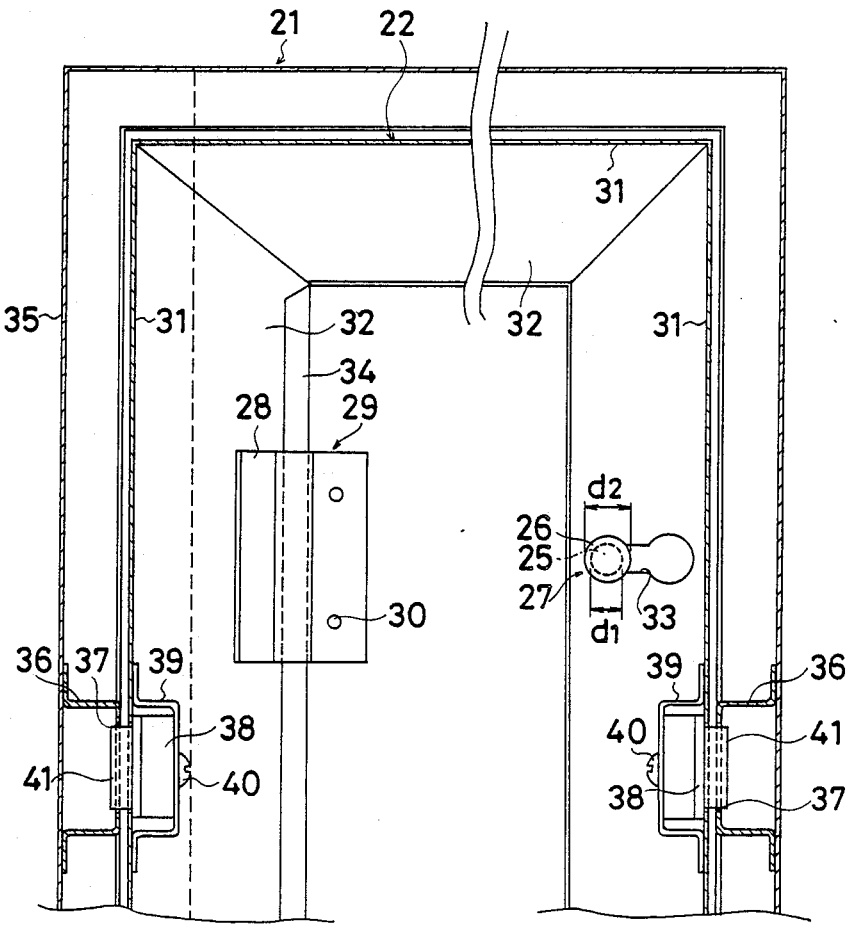
FIG. 5 is a sectional view taken on line II—II of FIG. 4.

That is, as shown in FIG. 4 and FIG. 5, a buttonlike locking member 27 provided with a head 26 of large diameter d2 on a head 25 of diameter d1 is provided projectingly on a top rear portion of a top sheathing 24 at an upper portion of the cabinet body 20, a rear portion of a locking piece 29 of leaf spring make with a downward bend 28 formed on the front end is fixed on a top front portion of the top sheathing 24 with a screw 30, the lower top frame 22 mounted detachably thereon is a frame with a side plate 31 U-shaped in section provided projectingly around, a lower end of the side plate 31 is bent properly inward to a base plate 32 with opening, the buttonlike locking member 27 on the upper surface of the cabinet top sheathing 24 is fitted in a rear portion of the base plate 32 at the rear end, a round-bellied groove 33 lockable to the head 25 is provided at the front end, a locking part 34 curled upward is provided on a front portion of the base plate 32 and the lower top frame 22 is inserted longitudinally and so engaged along the upper surface of the top sheathing 24. Brackets 36, 36 longitudinal vertically and U-shaped in section are provided inside of surface plates 35, 35 around the upper top frame 21 fittable to the lower top frame 22 and moving vertically which correspond to a longitudinal direction of the cabinet body 20, and a locking groove 37 is provided on the back of each bracket 36 vertically at a pitch P. On the other hand, a lower portion of an elastic body 38 such as synthetic resin or the like is fixed on the inside of the side plates 31, 31 coming longitudinally of the lower top frame 22 within brackets 39, 39 with a screw 40, and a claw 41 projecting externally on a top of the elastic body 38 is kept facing externally through a hole of each side plate 31, thereby locking in each locking groove 37 of the brackets 36, 36 coming longitudinally of the upper top frame 21.

Figure 6:
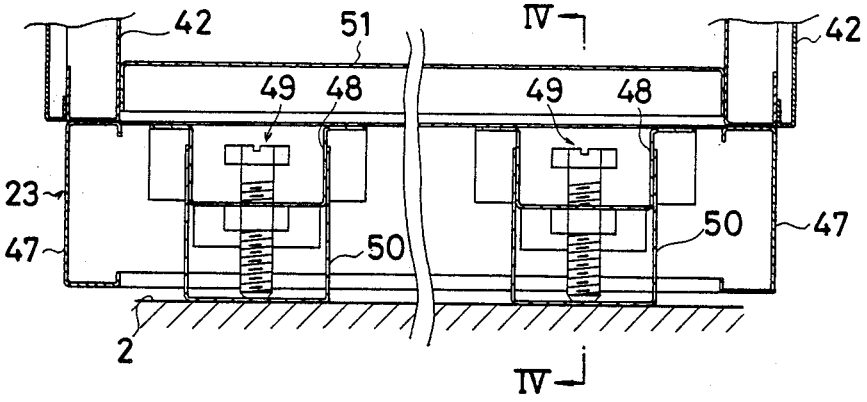
FIG. 6 is an enlarged sectional view taken on line III—III of FIG. 3.
Figure 7:
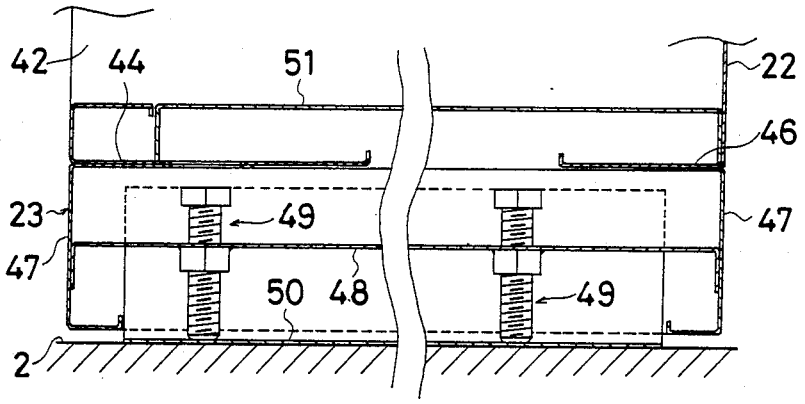
FIG. 7 is a sectional view taken on line IV—IV of FIG. 6.

On the other hand, in a lower end portion of the cabinet body 20, a lower end of left and right side plates 42, 42 and a front housing case 44 are coupled by proper means and both the side plates 42, 42 and a back plate 45 are also coupled by proper means, as shown in FIG. 6 and FIG. 7, a member 47 upsidedown U-shaped in section is surrounded between an inward horizontal portion of a lower end of the back plate 45 and a horizontal portion of the front housing case 44 with its horizontal flange part projected inward, U-shaped left and right adjuster receivers 48, 48 are stretched longitudinally on a lower surface of an upper horizontal flange part of the underframe 23, a male screw is fixed on a bottom portion of each adjuster receiver 48 apart by proper interval longitudinally, and adjusters 49, 49 paired longitudinally are mounted for ready move vertically downward independently. Then, reference numerals 50, 50 denote shoes longitudinal and U-shaped in section, which are inserted movably up and down from the lower surface of each adjuster receiver 48 and so interposed between a lower surface of the adjuster 49 and the floor surface 2.

In the aforementioned construction, in case the underframe 23 is first placed on the floor surface 2 with the shoe 50 put on a lower surface of the adjuster receiver 48, and then the cabinet body 20 is assembled and provided upright on the upper surface of the underframe 23, the lower top frame 22 of the upper dividing member 5 is covered with the upper top frame 23 beforehand, and when the upper top frame 23 is drawn up, the claw 41 on outside of each elastic body 38 in the lower top frame 22 has its lower side slant face pushed onto an end surface of the locking groove 37 on the back of each inside bracket 36 in the upper top frame 21, comes out around the side plate 31 of the lower top frame 22 against a spring force of the elastic body 38, comes to lock in the locking groove 37 at every constant pitch P of the upper top frame 21, thus adjusting the upper top frame 21 vertically stepwise, therefore a vertical size between an upper end of the upper top frame 21 and the lower top frame 22 is set beforehand to be somewhat smaller than that between an upper end of the assembled cabinet body 20 and the ceiling surface 3, the cabinet body 20 is provided upright on the underframe 23, and from inserting the lower top frame 22 toward the inner part side of the cabinet body 20 along an upper surface of the cabinet top sheathing 24, the buttonlike locking member 27 on the top sheathing 24 is engaged in the round-bellied groove 33 of the lower top frame 22, and the curled locking part 34 can be engaged with the downward bend of the locking piece 29. Then, after providing the cabinet body 20 upright on the underframe 23 as described, the cabinet is stretched between the room floor surface 2 and the ceiling surface 3 by pushing each adjuster 49 downward from the bottom opening of the cabinet body 20 by means of a tool such as screwdriver, wrench or the like, upper and lower spaces of the room are thus filled up by the cabinet and the cabinet is prevented from being turned slantingly or upside down.

As described above, a vertical size between both upper and lower top frames 21, 22 of the upper dividing member 5 to be mounted on an upper end of the cabinet body 20 can be set stepwise, therefore if the vertical size between the upper and lower top frames 21, 22 is set in order prior to installing a plurality of assembled cabinets as the cabinet body 20, then mounting is considerably simplified, and the cabinets can be disposed with a vertical spacing between the cabinet upper end and the ceiling surface 3, namely a row of the cabinet upper ends trued up uniformly. Then, a surface appearance of the upper top frame 21 will be surrounded by the lower top frame 22, or the elastic body 38 with the claw 41 for adjusting a spacing between both the top frames 21, 22 stepwise may be provided on a side of the upper top frame 21 in this case. Further, the claw 41 may be provided in a pair not only longitudinally of the cabinet frontage in general but also horizontally of the cabinet. Furthermore, the lower pedestal 4 bearing a lower end of the cabinet can be controlled fine vertically stepwise, therefore lower ends of the cabinets provided laterally can be aligned in order, and a safe working will be ensured for adjusting the cabinets to stretch between the room floor surface 2 and the ceiling surface 3. With a base plate 51 of the cabinet detachable, the adjuster 25 will be operated therefrom, and thus the adjusting device cannot be observed from outside of the cabinet, which may look nice.

Figure 9:
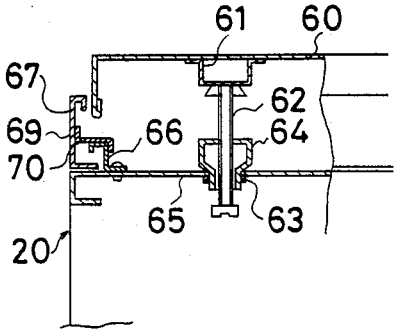
FIG. 9 is a main part longitudinal sectional front view of the top dividing member of FIG. 8.
Figure 8:
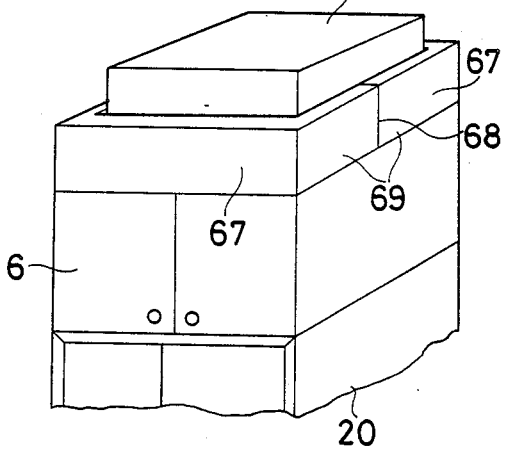
FIG. 8 a perspective view of a cabinet upper portion representing another example of a top dividing member.
Figure 10:
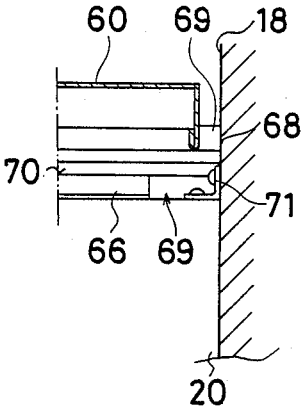
FIG. 10 is a longitudinal sectional side view representing another example of the top dividing member.

Then, as another structure of the upper dividing member 5 mounted on an upper end of the cabinet body 20, that of FIG. 8 and FIG. 9 may be employed. Here, a dividing frame 60 is a downward-open boxed member with an area almost same as the top of the cabinet body 20, bearing metal fittings 61 . . . provided at proper portions on an inside lower surface thereof are placed on an upper end of an adjusting screw 62, the adjusting screw 62 is fitted in a fitting hole 65 formed on the top sheathing of the cabinet body 20, fastened by a clamp ring 63 and mounted on a cap 64 fitted on the top of the cabinet body 20 as projecting upward through the fitting hole 65 of the cabinet top sheathing, and a guide rail 66 of a desirable shape in section is mounted at opposite side edge portions on the top of the cabinet body 20 with a screw or other means, which supports a cover 67. With one side as an open edge 68, the cover 67 is formed into a U-shape as observed in plane, a slider part 70 to be fitted slidably in the guide rail 66 is fused on an inside of opposite sides 69, then a proper rugged portion (not indicated) is formed on a contact surface of the opposite sides 69 and the guide rail 66 not to slide unexpectedly in the direction where the cover 67 is detached, a length of the opposite sides 69 of the cover 67 is same as an upper side edge of the cabinet body 20 or half thereof, which will be so selected alternatively according to a place where the cabinet is installed. That is, when the cabinet is installed at a proper portion such as center or the like so as to serve as a screen in the room, the covers 67, 67 having a short side each are mounted longitudinally of the cabinet, as shown in FIG. 8, so as not to expose the open edge 68, and when the cabinet body 20 is disposed close to a wall surface 18 as shown in FIG. 10, the cover 67 having the long side 69 almost same in size as the depth of an upper side edge of the cabinet body 20 is mounted from ahead of the cabinet body 20, thereby mounting a coupling metal fitting 71 to the wall surface 18 on the top of cabinet body by means of a space formed by the open edge 68 positioned on the rear side.

In the above-described upper dividing member 5, the dividing frame 60 is brought into contact with the ceiling surface 60 from operating the adjusting screw 62 from inside the cabinet body 20 and a space between the dividing frame 60 and the top of cabinet body is covered by the cover 67, therefore a gap between the top of the cabinet body 20 and the ceiling surface 3 is filled up to a full function and effect inherent in such screen, and the cover 67 can be mounted simply by sliding and fitting in the guide rail 66 mounted on the top of cabinet body, further the open edge 68 is formed on the cover 67, and when the cabinet body 20 is disposed close to the wall surface 18 by means of the open edge 68, the coupling metal fitting 71 for preventing the cabinet body 20 from turning slantingly ahead can be mounted simply on the top of the cabinet body 20, and not only it can be prevented from turning slantingly as mentioned but also a useless exposure of an electric wiring by disposing the electric wiring such as lighting or the like which is mounted on the ceiling surface 3 by means of the open edge 68 on the top of the cabinet and covering with the cover 67.

Figure 11:
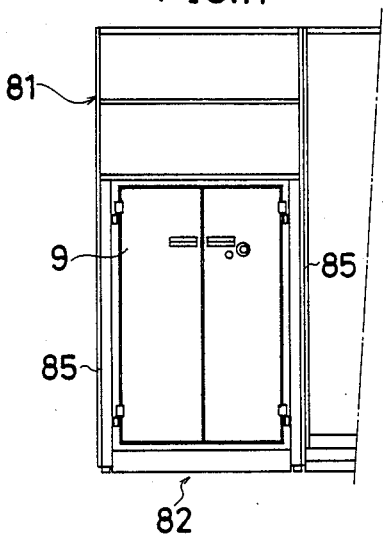
FIG. 11 is a front view of a cabinet portion having a dead part.
Figure 12:
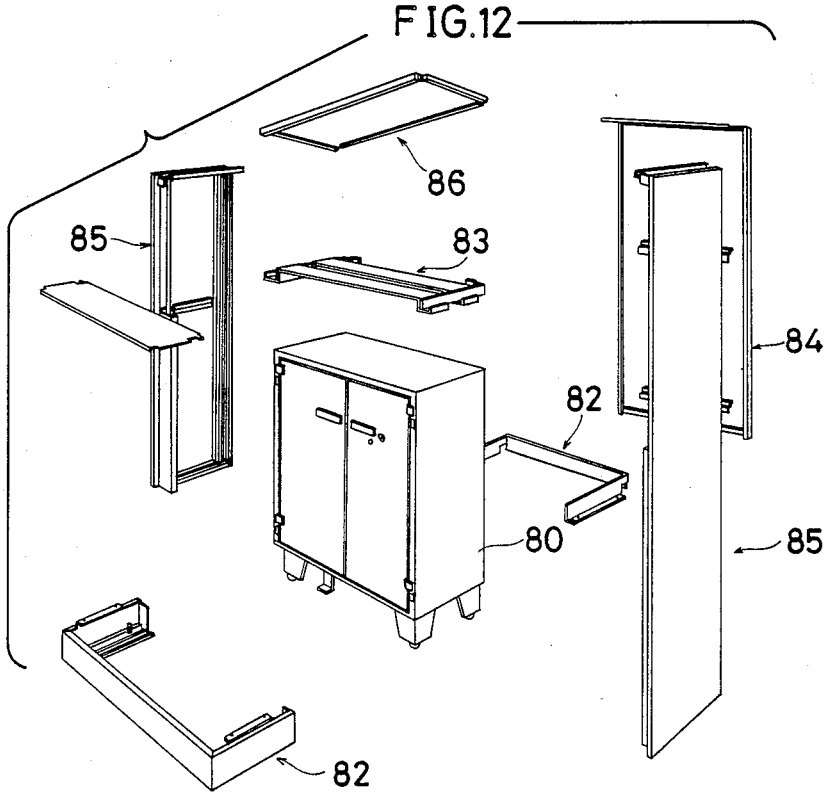
FIG. 12 is an exploded perspective view of the cabinet of FIG. 11.

Referring next to various cabinets constituting the container part 1, for example, a heavyweight immovable 80 such as safe or the like shown in FIG. 1 can be installed within the assembled cabinet as shown in FIG. 11. The assembled cabinet with such immovable 80 incorporated therein comprises the immovable 80 such as safe or the like which works as an assembly base or core material and a cabinet boxed member 81. As shown in FIG. 12, the cabinet boxed member 81 comprises combining a lower frame 82 (to be divisible longitudinally as illustrated) fitted to a lower end of the immovable 80 in contact with the floor, a coupling metal fitting 83 fitted to a top of the immovable 80, a rear plate 84 stopped detachably on the lower frame 82 and the coupling metal fitting 83, an opposite side plate 85, and a top sheathing 86 provided on an upper end of the rear plate 84.

Such assembled cabinet comprises covering the large-sized and heavyweight immovable 80 such as safe or the like by the cabinet boxed member 81, therefore the immovable such as safe or the like will never be disposed as exposed in the room to a high effect in theft prevention, and dimensions or other requirements of each member for the cabinet boxed member 81 are properly set in consideration of a harmony with other cabinets disposed in the room, thus keeping an external appearance of the entire cabinet in order without causing an unbalance on the interior layout unlike hitherto where the immovable such as safe or the like is disposed in an offhand manner, further the immovable installed beforehand at a predetermined position in the room as mentioned is covered by the assembly cabinet boxed member as a base for assembling the cabinet boxed member, thus loading reasonably the immovable within the cabinet without involving a hard work of carrying such heavyweight immovable into the cabinet boxed member, which is regarded as impossible realistically.

Figure 13:
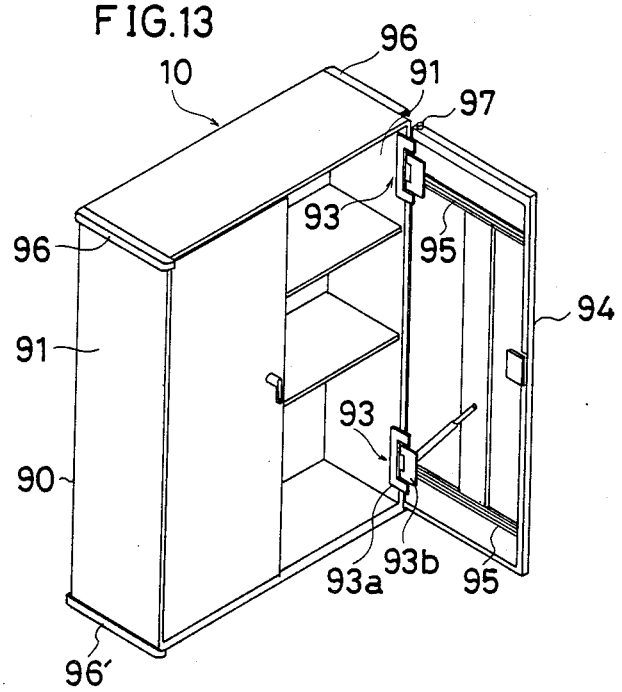
FIG. 13 is a perspective view of a cabinet 10 in FIG. 1.

Next, the double-hinged cabinet 10 in FIG. 1 is, for example, as shown in FIG. 13. The cabinet 10 comprises disposing hinges 93, 93 at proper positions vertically of a front end portion of opposite side plates 91, 91 of a cabinet body 90 to fix door side fitting pieces 93*a*, 93*a* on the side plate 91, fixing a traveling rail 95 almost C-shaped in section at positions corresponding to the hinges 93, 93 on the inside of one door almost horizontally, inserting a slider (not indicated) longitudinal horizontally in the rail 95 slidably, fixing the slider on the door side fitting piece 93*b* in the hinge 93. Reference numerals 96, 96' denote guide rails provided longitudinally on outside upper and lower end portions of the side plate 91, and 97 denotes a roller disposed on opposite upper and lower portions of a base end portion of a door 94 so as to rotate in the guide rails 96, 96'. Thus the door 94 is ready for rotating to the body 90 through the hinges 93, 93, and is shiftable longitudinally along an outer surface of the side plate 91 from the state where it opens almost at right angles to a front of the body.

Figure 14:
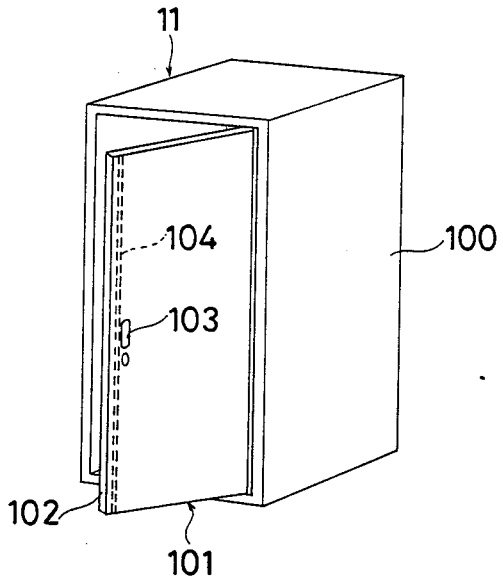
FIG. 14 is a perspective view of a cabinet 11 in FIG. 1.

Then, the cabinet 11 in FIG. 1 comprises mounting a right-hinged door 101 rotatably on a front opening of a cabinet body 100 as shown in FIG. 14, a pull frame 103 made of synthetic resin or the like is mounted on a pull hole part perforated at a proper portion of a front panel 102 toward an open free end of the door 101, and a latch rod 104 with a latch claw mounted on opposite ends is turned indirectly through a pull hole of the pull frame 103, thereby constructing the door 101 closeable. That is, one side of the door 101 is pivoted, one longitudinal latch rod 104 is disposed on an inside of the door almost in parallel with the pivot, portions near opposite ends of the latch rod 104 are journaled rotatably in a pair of bearing members fixed near to a pair of side edge plates toward a free end of the door 101, the latch claws are fitted unturnably in opposite ends of the latch rod 104, the latch rod 104 is turned through manipulation from a front side of the door 101, thereby engaging the latch claws with an engaging part on a side of the cabinet body 100.

Figure 15:
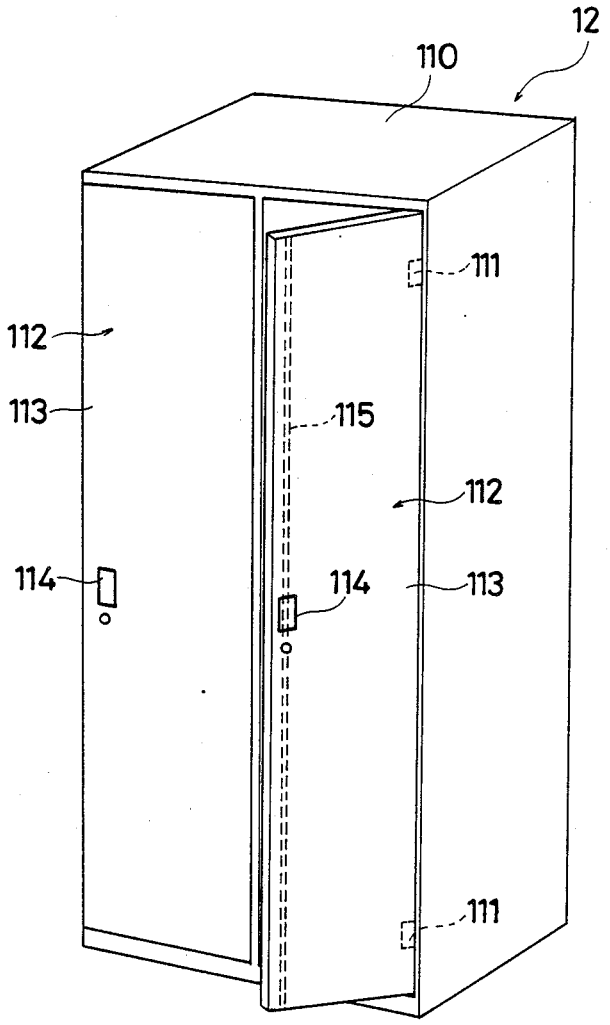
FIG. 15 is a perspective view of a cabinet 12 in FIG. 1.

Next, the cabinet denoted by numeral 12 in FIG. 1 is a metallic locker shown in FIG. 15, and the locker 12 comprises a locker body 110 and a righthinged door 112 mounted turnably to a front opening of the locker body 110 through hinges 111, 111, and as in the case of the above-described cabinet 11, a pull frame 114 of synthetic resin make is provided at a proper portion of a front panel 113 toward an open free end of the door 112.

Figure 16:
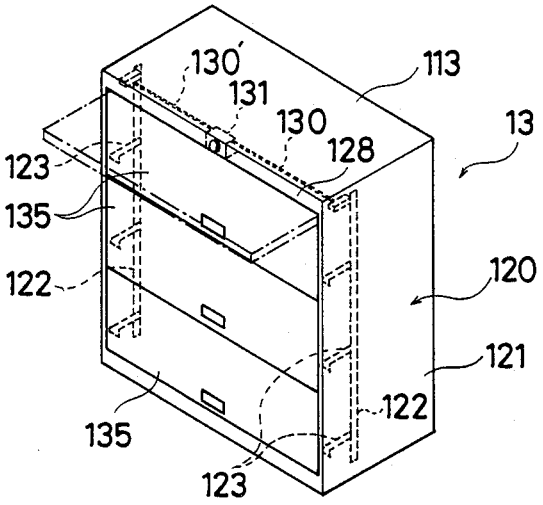
FIG. 16 is a perspective view of a cabinet 13 in FIG. 1.
Figure 17:
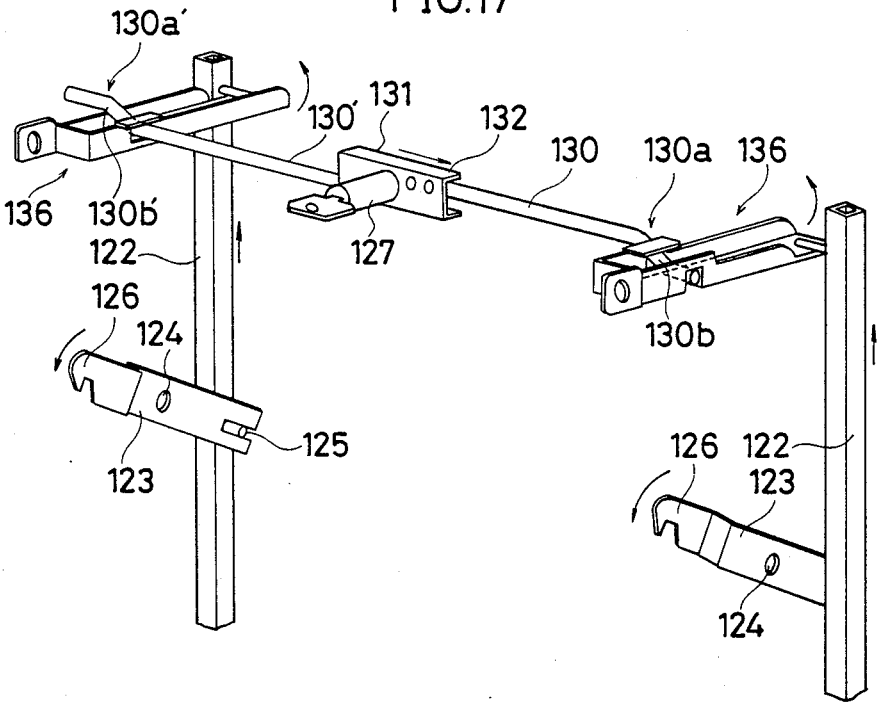
FIG. 17 is a main part perspective view of a lock device cabinet 13.

The drawer type door cabinet denoted by numeral 13 in FIG. 1 comprises installing drawers in multistage between left and right side plates 121, 121 as shown in FIGS. 16 and 17. The illustrated cabinet has three stages of drawers (not indicated) installed movably back and forth between the opposite side plates 121, 121 of a cabinet body 120, a door 135 is provided turnably upward at every portions corresponding to each drawer between front end edges of the opposite side plates 121, 121 in the cabinet body 120, and the construction is such that the drawers are ready for drawing by turning the door 135 up to a horizontal state and thrusting and containing into the cabinet body 120 along a guide rail (not indicated). Then, a longitudinal rod 122 square in section is provided movably up and down at a portion this side of the insides of opposite side plates 121 of the body 120, a locking rod 123 is pinned at an intermediate portion 124 on the insides of opposite side plates 121 at every portion corresponding to each door 135, one end of the locking rod 123 is locked to the longitudinal rod 122 with a pin 125, and thus when the longitudinal rod 122 ascends, it comes to engage all at once with a locking part 126 formed on another end portion of the locking rod 123 and an engaging part formed on the back of each door 135, thus locking the drawers, and when the longitudinal rod 122 descends, the engaged state is released and the door 135 is ready for turning to release the locked state.

In the drawings, 127 denotes a lock fixed on an inside of an upper housing case 128 of the cabinet body 120, 130, 130' denote cross rods of a round bar disposed horizontally to extend toward the side plates 121 each from behind the lock 127, the lock 127 has a key hole faced on a front of the cabinet body 120, and couples base end portions 132, 132' of both cross rods 130, 130' through a coupling member 131. The coupling member 131 is U-shaped in section, couples the flat base end portions 132, 132' of the cross rods 130, 130' to opposite end portions of the base plate by pins, thus keeping the cross rods 130, 130' and the coupling member 131 almost linear in posture, and thus both the cross rods 130, 130' shift horizontally along the line of axis by operating the lock. Then, a slope 130*b* extending slantingly downward is formed on a nose portion 130*a* of the cross rod 130 positioned on the right side of both cross rods 130, 130', a slope 130*b'* extending slantingly upward is formed on a nose portion 130*a'* of the cross rod 130' positioned on the right side, the upper surface of the downward slope 130*b* in the right side cross rod 130 turns upwardly a lever coupled to an upper end of the right side longitudinal rod 122 according as both the cross rods 130, 130' shift in the same direction (indicated by B in the drawing), and the upper surface of the upward slope 130*b'* in the left side cross rod 130' turns upwardly the lever 136 coupled to the left side longitudinal rod 122, thus locking the drawer thrusted into the cabinet body 120, and when the lock 127 is released from the lock state, both the vertical rods 122 descend according to the reverse action, and each locking rod 123 is disengaged from each door 135 to release the locked state.

As described above, since the cross rods 130, 130' merely shift horizontally according to the operation, the cross rods 130, 130' can be provided close to a lower surface of a top sheathing 133, lower end surfaces of the cross rods 130, 130' are kept on a constant level regardless of the locking operation, a dead space will not arise under the top sheathing 133 more than necessary, and thus a vertical width of the upper housing case 128 to hide the lock 127 and the cross rods 130, 130' can be minimized. Further, both the cross rods 130, 130' can be formed and also wrought simply by bending round bar or other material.

Then, the above-described construction is that for locking the drawers by locking the door 135 journaled in the cabinet body 120, however, as indicated by numeral 7 in FIG. 1, in the normal drawer cabinet with drawers merely installed therein, the locking rod may be made detachable to the locking part provided on outside of the drawers. Then, it is not necessary to lock opposite sides of the drawer, and either one side may be locked. Further, the longitudinal rod will be energized upwardly on a spring, and the drawers may be locked according as the longitudinal rod descends, however, the direction in which the cross rods shift for operating the lock will be reversed, or the direction in which the slopes incline will be reversed in this case.

Figure 18:
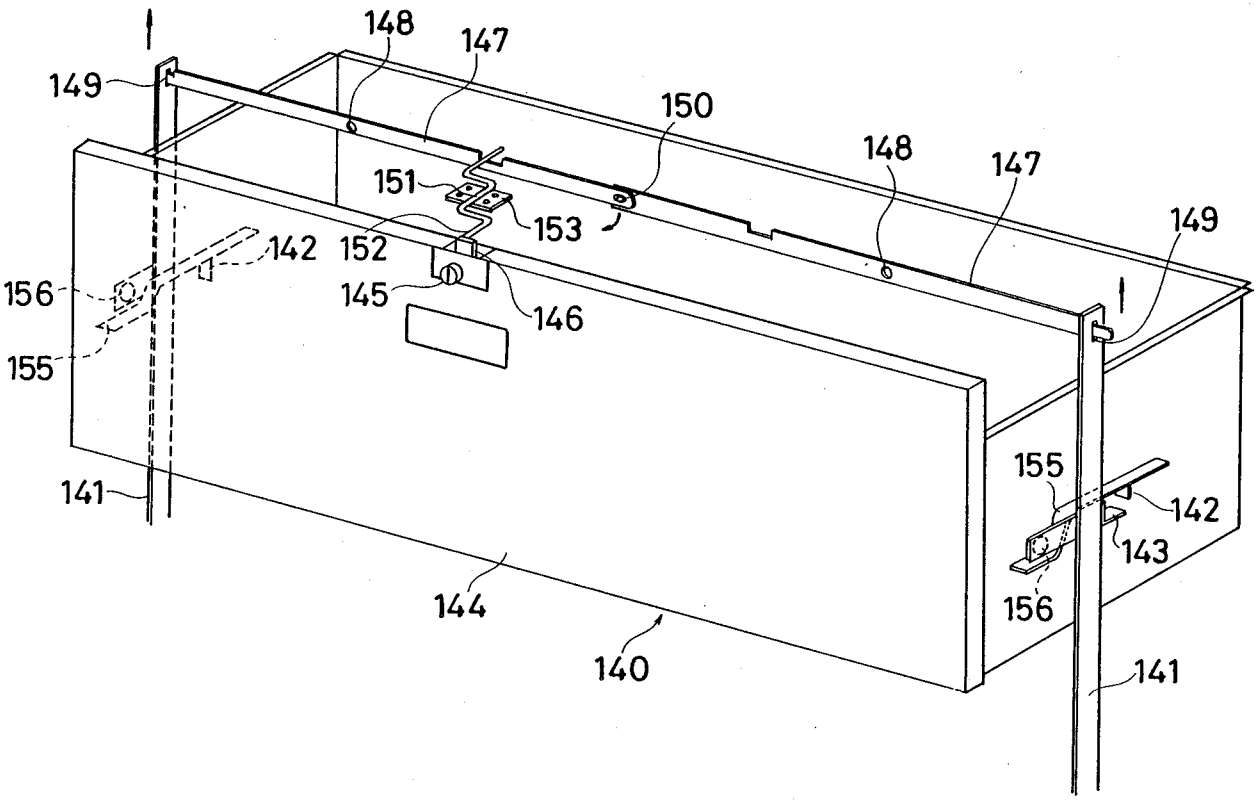
FIG. 18 is a perspective view of an example of the lock device for drawer cabinet.

Still further, that of FIG. 18 may be employed as a locking device in the drawer cabinet 7.

In the drawing, numeral 140 denotes a drawer supported movably back and forth between left and right side plates of the cabinet, 141, 141 denotes a pair of longitudinal rods provided movably up and down on insides of the side plates, and a locking side 143 detachable with the front of an engaging side 142 provided on outsides of the side plates of the drawer 140 on each stage is provided projectingly on an inside of the longitudinal rod 141. A reference numeral 144 denotes a front panel of each drawer 144, and 145 denotes a lock provided near an almost central upper end of the front panel 144, and the construction is such that a locking piece 146 of the lock 145 projects upwardly by a proper size to a locking part (not indicated) perforated in the lower surface of a front frame of the cabinet at the time of locking.

Reference numerals 147, 147 denote a pair of lever rods disposed on a lower surface of the cabinet top sheathing in parallel with the front panel 144 of the drawer 140, halfway portions 148, 148 of both the lever rods 147, 147 are pivoted on a horizontal shaft, ends of the lever rods 147, 147 are engaged with upper end engaging holes 149, 149 of the longitudinal rods 141, 141 each, and other ends of the lever rods 147, 147 are coupled mutually by a horizontal pin 150. A kinematic motion for lifting the longitudinal rods 141, 141 according to an ascent of the locking piece 146 of the aforementioned lock 145 comprises a turning shaft 151 disposed on a lower surface of the top sheathing rectangularly to the drawer front panel 144 and crank arms on longitudinal ends thereof, the turning shaft 151 is journaled turnably in a bearing plate 153 mounted on a horizontally longitudinal reinforcing plate fixed on the lower surface of the top sheathing, and the crank arms 152, 152' projecting mutually counter on longitudinal ends of the turning shaft 151 are disposed shiftingly at 180° each other. Then the rear crank arm 152' is brought into contact with a top notched portion between the horizontal shaft of intermediate portion 154 of the lever rod 147 and a coupled portion of ends of the lever rods 147, 147 by the horizontal pin 150, and the crank arm 152 is kept facing over the locking piece 146 in the aforementioned lock 145.

Then, a reference numeral 155 denotes a longitudinally inclined guide plate provided on outer surfaces of the side plates of the drawer 140, 156, 156 denote contact shoes provided on both longitudinal rods 141, 141, and when each drawer 140 is moved longitudinally, the contact shoe 156 comes in contact with an upper surface of the inclined guide plate 155, moves the longitudinal rod 141 correspondingly to a head of the inclined guide plate 155, and when one drawer 140 is drawn out of the cabinet body, the locking piece 143 on a side of the longitudinal rod 141 ascends to a front of the locking piece 142 in the other drawer 140 contained within the cabinet body to give a check to double drawing operation of the drawer 140, thus preventing the cabinet body from falling forward.

According to the above-described construction, after all the drawers are contained within the cabinet body, a key is inserted in the lock 145 on the front panel of the drawer 140, and the locking piece 146 is projected upwardly, then the locking piece 146 is thrusted into the locking part hole on the front frame of the top sheathing, the drawer 140 can thus be locked to the top sheathing, and the front crank arm 152' pushes a portion toward one end of the one lever rod 147 downward. Thus, the longitudinal rod 141 engaging therewith is moved upwardly through the other end of the lever rod 147, the longitudinal rod 141 on one end of the other lever rod 147 coupled turnably with the lever rod 147 by the horizontal pin 150 is moved upward concurrently therewith, and the locking piece 143 projecting to each longitudinal rod 141 comes to a front of the engaging piece 142 of each drawer side plate, thus locking each drawer.

For releasing the locked state to the contrary, the key is inserted in the lock 145 in the drawer, and the locking piece 146 is drawn downward, then the front crank arm 152 turns downward, ends of the lever rods 147, 147 and the longitudinal rods 141, 141 descend on empty weight to the contrary, thus releasing the locked state of all the drawers.

Then, the rear crank arm 152' of a kinematic motion for the left side lever rod 147 and the locking piece 146 may be disposed to come in contact with an upper surface side of the right side lever rod 147, and the drawer can be locked on the left side only from disengaging the right side lever rod 147, the longitudinal rod 141 and the engaging piece 142 on the right side of the drawer 140.

Figure 19:
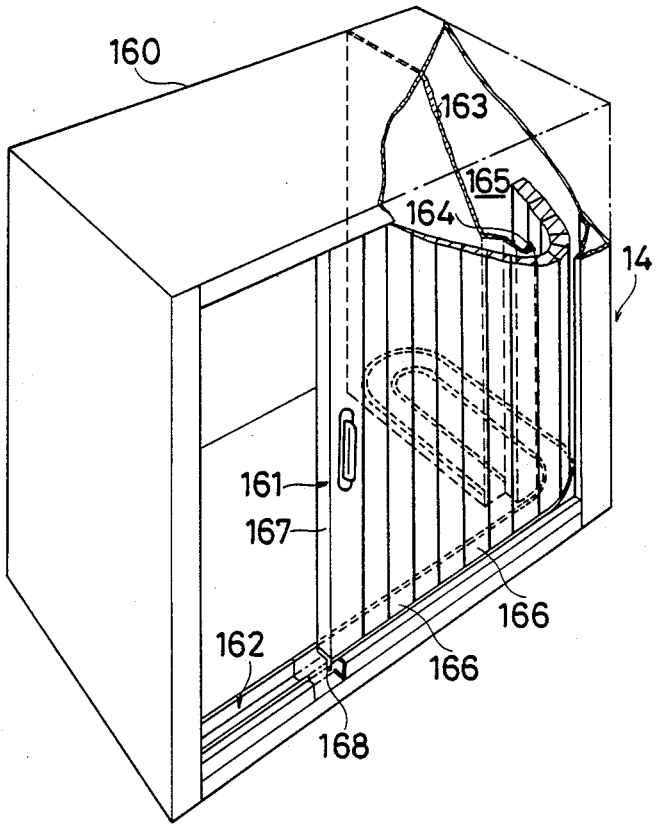
FIG. 19 is a fragmentary sectional perspective view of a cabinet 14 in FIG. 1.
Figure 20:
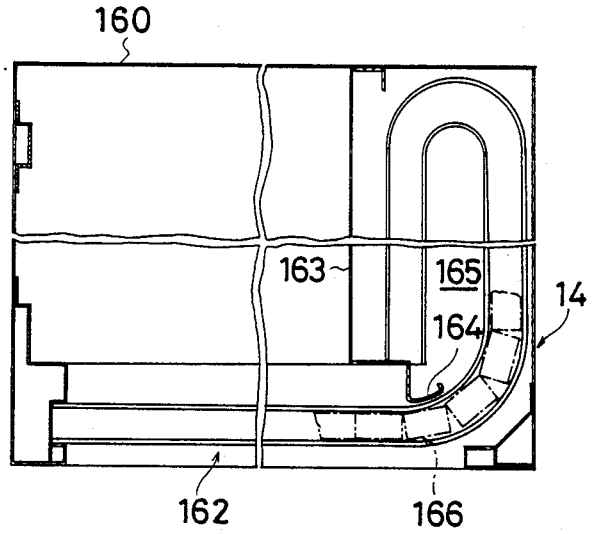
FIG. 20 is a transverse sectional view of the cabinet 14.

Next, the shutter cabinet denoted by numeral 14 in FIG. 1 is shown in FIGS. 19 and 20.

In the drawings, a reference numeral 160 denotes a cabinet body, 161 denotes a shutter, 162 denotes a guide groove, 163 denotes a divider, and 164 denotes a support member. The cabinet body 160 comprises setting the shutter 161 in a front opening, forming a space 165 for containing the shutter 161 therein by partitioning with the divider 163, and providing the guide groove 162 for guiding the shutter 161 on the top sheathing and the base plate. The shutter 161 comprises coupling a multiplicity of constituent rods 166 . . . turnably inward, providing a closing pull 167 on one end, and providing a slider 168 almost L-shaped in section on lower portions of the constituent rods 166 . . . .

Figure 21:
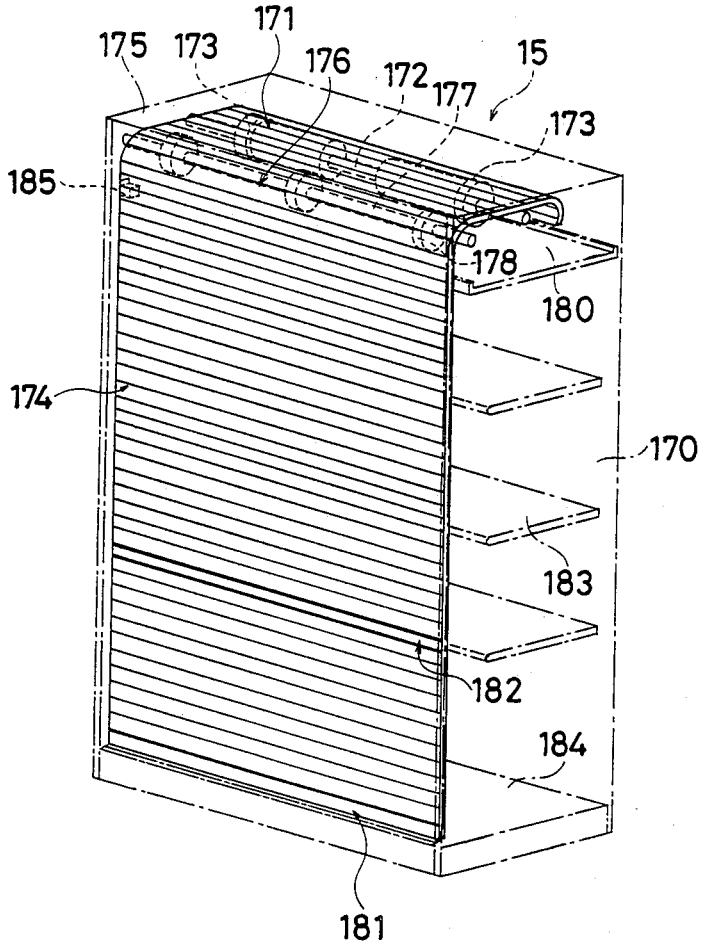
FIG. 21 is a perspective view showing a general construction of a shutter roller for cabinet 15 in FIG. 1.

Then, as shown in FIG. 21, the shutter cabinet 15 of FIG. 1 is that of having a shutter door which comprises hoisting the shutter at an upper portion of the cabinet, a shutter hoisting means 171 is mounted at central or rear portion, for example, on the upper portion of a body 170, or as illustrated, a hoisting disk 173 is mounted properly apart on a shaft 172 journaled at the upper portion of the body 170, and while not so indicated, the hoisting means 171 provided with a spring for rotating and energizing the shaft 172 in the direction where a shutter 174 is hoisted is disposed, a rotation guide 176 close to the back of the shutter 174 for rotation guiding or, for example, provided with a rotation guiding disk 178 in a proper number on a shaft 177 journaled between the side plates of the cabinet body 170 is disposed at a cabinet corner 175 on the top of cabinet body 170 which is ahead of the hoisting means 171, namely the position close to the back of cabinet front housing case.

Then, in the drawing, a reference numeral 180 denotes a top cover for hiding the hoisting means and the rotation guide 176, 181 and 182 denote pulls on a lower stage and upper stage which are provided on a lower end and midway of the shutter 174 respectively, 183 denotes a shelf, 184 denotes a base plate, 185 denotes a stopper mounted on an inside of the lower portion of the shutter 174, and an upper bound at the time of hoisting of the shutter 174 can be regulated by the stopper 185.

Figure 22:
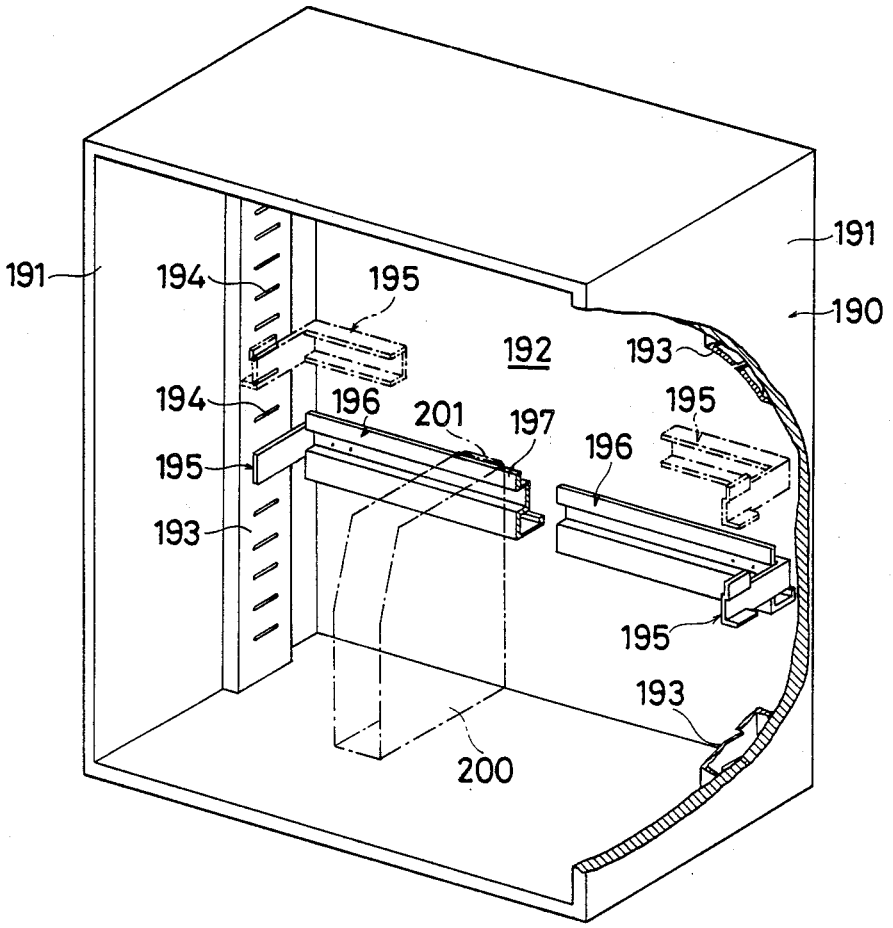
FIG. 22 is a perspective view of a tray inserted within the cabinet.

Further, a tray mounting device shown in FIG. 22 may be provided within various cabinets constituting the container part. A reference numeral 190 in the drawing denotes a cabinet body, 191 denotes a side plate, 192 denotes a back plate, and a ridged reinforcing part 193 or, for example, a channeled member is disposed opposite vertically on inside of the side plates 191 and fixed on spot welding or the like, thereby mounting on an inside of the side plate 191, and a multiplicity of fitting holes 194 are provided vertically on the surface of the ridged reinforcing part 193.

Then, the tray mounting device comprises, as illustrated, a mounting part 195 L-shaped in plane, a transverse hanger 196 almost same in width as that of internal space of the cabinet body 190, the mounting part 195 is armlike in shape as illustrated, and its base end is fixed with the hanger 196 each other. Accordingly, the mounting part 195 is armlike to the hanger 196 in an assembled state, and the tray mounting device is almost U-shaped in plane. If the mounting part 195 is locked at the height same as fitting holes 194 . . . of the ridged reinforcing part 193 provided on the opposite side plates 191, 191 of the cabinet body 190, then the hanger 196 is laid transverse between the mounting parts 195. Then, from locking a hook 201 formed on the back of an upper portion of a bookcaselike tray 200 indicated by an imaginary line on an upper vertical support 197, the tray 200 can be arranged and so contained in the cabinet body 190. Further, the mounting position can be changed arbitrarily by changing an engaging position of the hook 201 with the upper vertical support 197 crosswise. According to the tray mounting device, the bookcaselike tray 200 can be mounted within the cabinet body 190 simply by engaging the hook 201 provided on the back of the tray 200 with the upper vertical support 197 of the hanger 196, and it can be disassembled and miniaturized to packaging before use. Then, these members are mounted on a dead space of the surfaces of the side plates 191 and the back plate 192 in the cabinet body 190, therefore an available area in the cabinet will be maximized.

Figure 23:
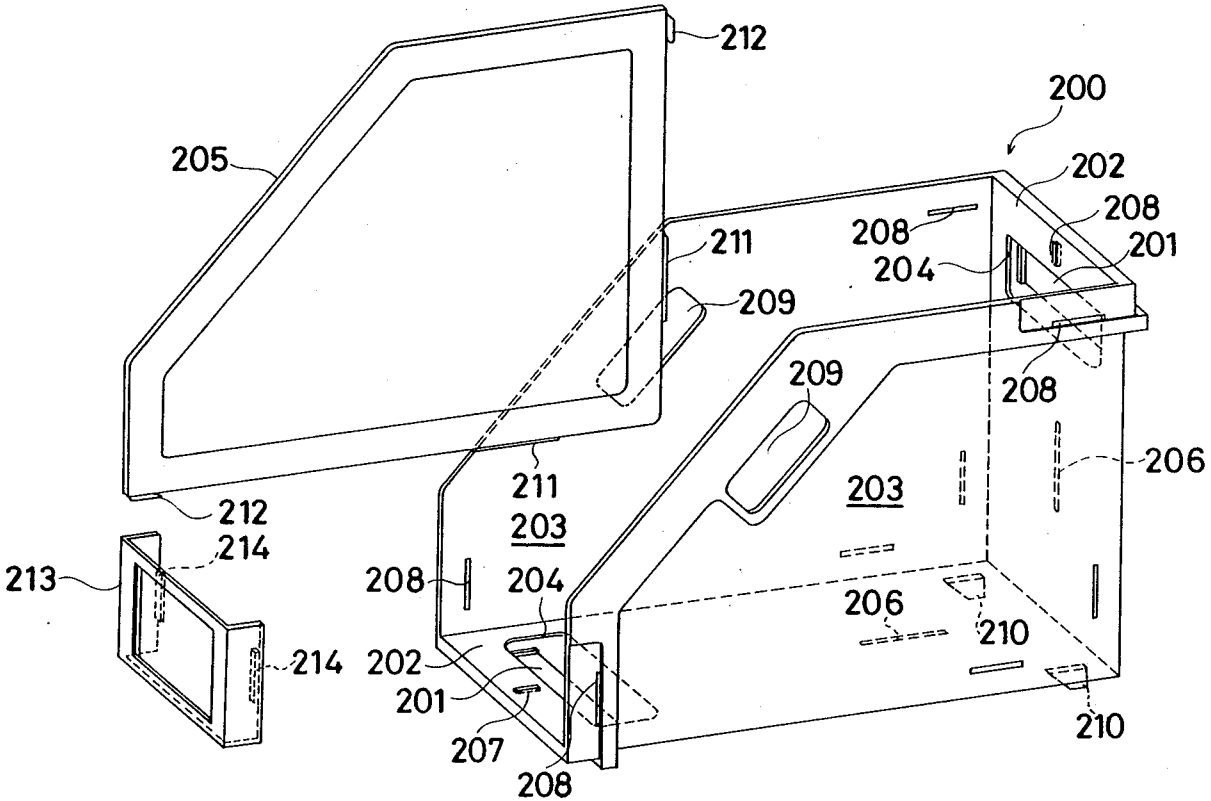
FIG. 23 is an exploded perspective view of a bookcaselike tray.

The tray 200 is shown in FIG. 23. For the tray 200 illustrated therein, two back plates 202, 202 are disposed almost at right angles to form a back plate part L-shaped in section, a rectangular side plate 203 with one angular part removed is formed integrally on a side edge of the back plate part to a bookcaselike tray body, a rectangular opening 204 is provided near to a free end portion of each back plate 202 as illustrated, the hook piece 201 is provided projectingly somewhat apart from an outer surface of the back plate 202 through an open edge of the opening 204 on a free end side of the back plate 202, and an insertion hole 206 and an engaging hole 207 for the divider 205 are provided at proper portions longitudinal of the back plate 202.

Then, an elongated grooved engaging hole for engaging the claw 20 of a caption 213 is provided at a portion of the side plate 203 on a free end side of the back plate, namely a position denoted by numeral 208 in the drawing.

A reference numeral 209 denotes a handle port, 210 denotes a foot almost same in height as the hook 201.

For insertion of the divider 205 into the tray 200, one engaging claw 212 is locked in one engaging hole 207 with each projection 211 inserted in the insertion hole 206 of the tray 200, the other engaging claw 212 is fitted forcedly in the other engaging hole 207, thereby mounting the divider 205 within the tray 200 stably and firmly.

The projection 211 and the engaging claw 212 of the divider 205 are engaged with the insertion hole 206 and the engaging hole 207 within the tray 200 respectively, and the caption 213 is locked in the engaging hole 208 at a proper position with a claw 214, then the tray 200 is ready for service as illustrated or in the state where it is turned 90 degrees, and the divider 205 and the caption 213 thus mounted may function stably, subdivided spaces are provided properly for containing a magnetic tape or other various goods within the tray 200, goods contained therein are indicated straight, and a stout structure is obtainable even from providing each function.

Figure 24:
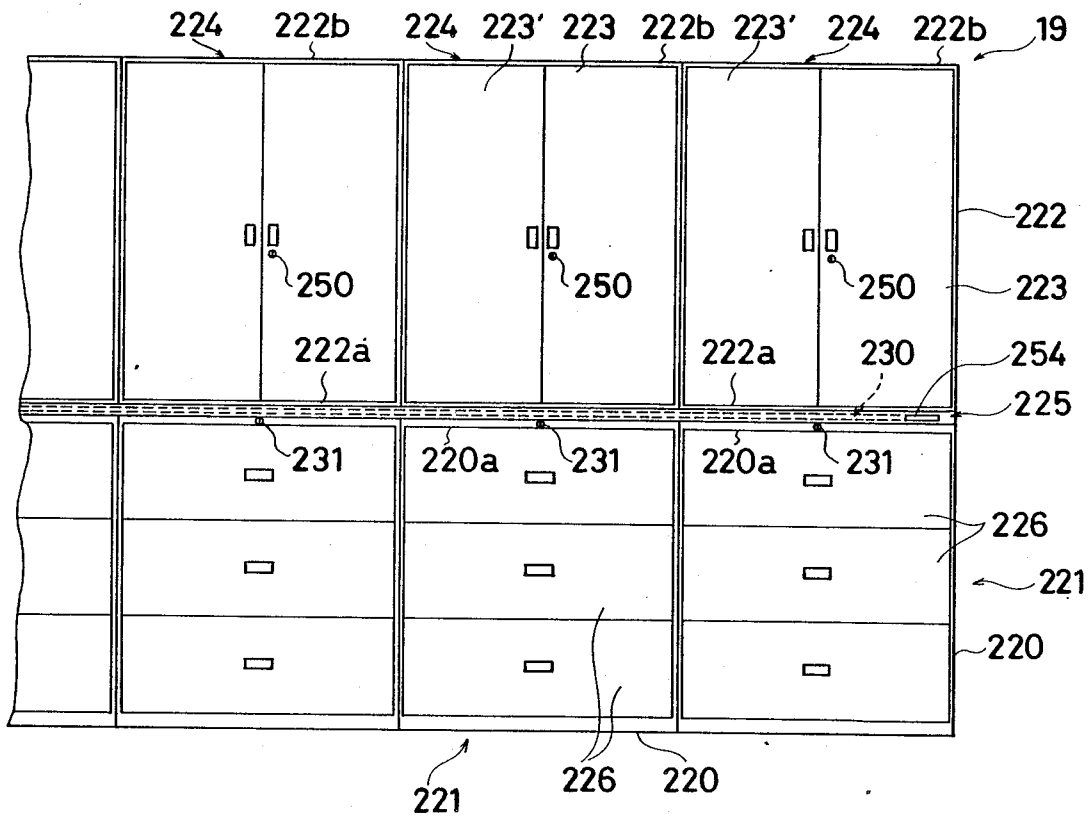
FIG. 24 is a front view of one part of cabinets constituting a container part provided with an all-lock device.

Next, as cabinets 19 constituting the container part 1, that of FIG. 24 comprises arranging a plurality of lower cabinets 221 with a drawer 226 disposed in multistage vertically within a cabinet body 220, providing a shelf (not indicated) or the like in multistage within an upper cabinet body 222, and arranging a plurality of upper cabinets 224 provided with a pair of horizontally double-hinged closing doors 223, 223'.

A reference numeral 225 denotes a hollow intermediate unit disposed between the aforementioned upper and lower cabinets 221, 224, or between a top sheathing **220*a* of the lower cabinet body 220 and a lower housing case 222*a* of the cabinet body 222 in the upper cabinet 224, and a principal part of an all locking device 230 for locking all the upper and lower cabinets 221, 224 concurrently is disposed in the intermediate unit 225**.

Figure 25:
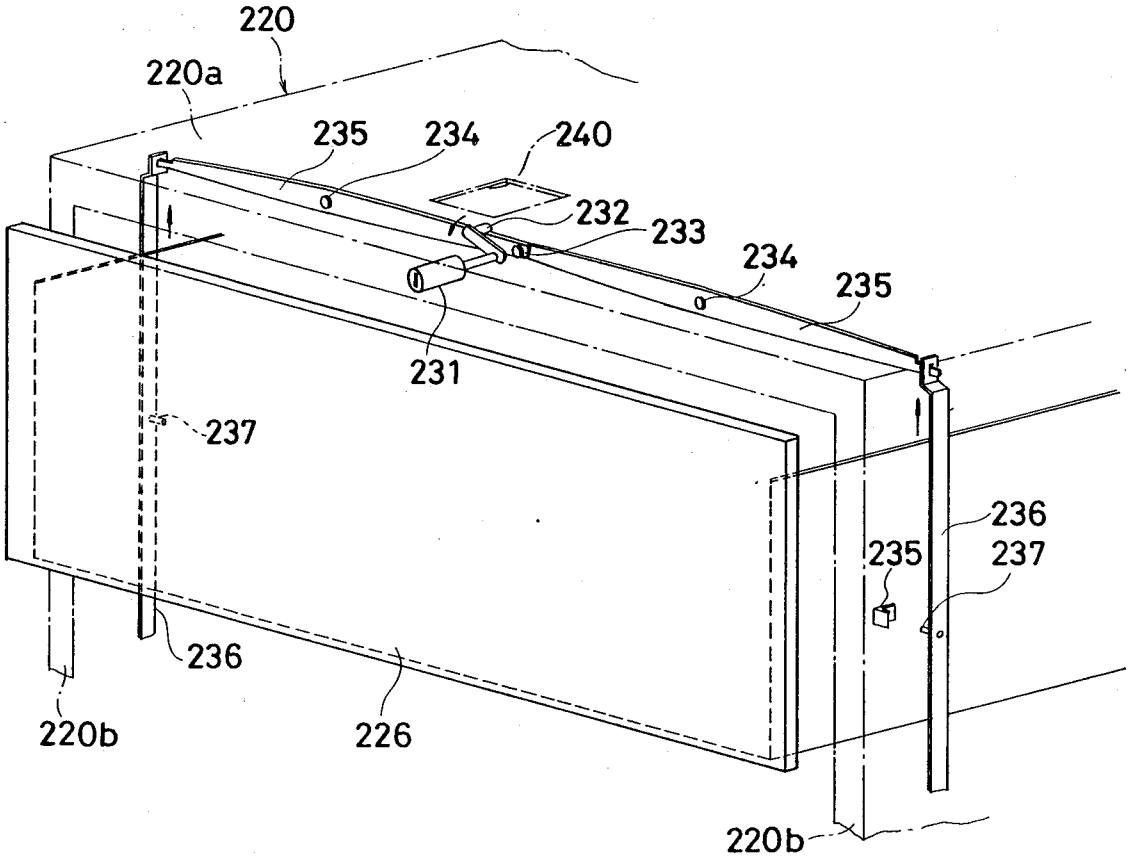
FIG. 25 is a perspective view showing a locking motion for multistage drawer in the cabinets of FIG. 24.
Figure 26:
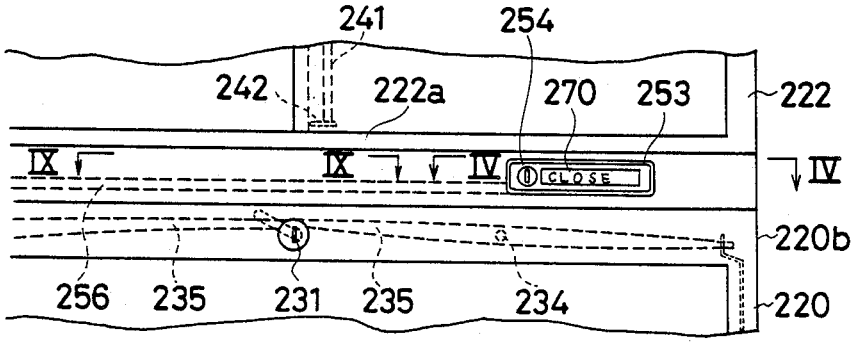
FIG. 26 is a main part enlarged front view of FIG. 24.
Figure 27:
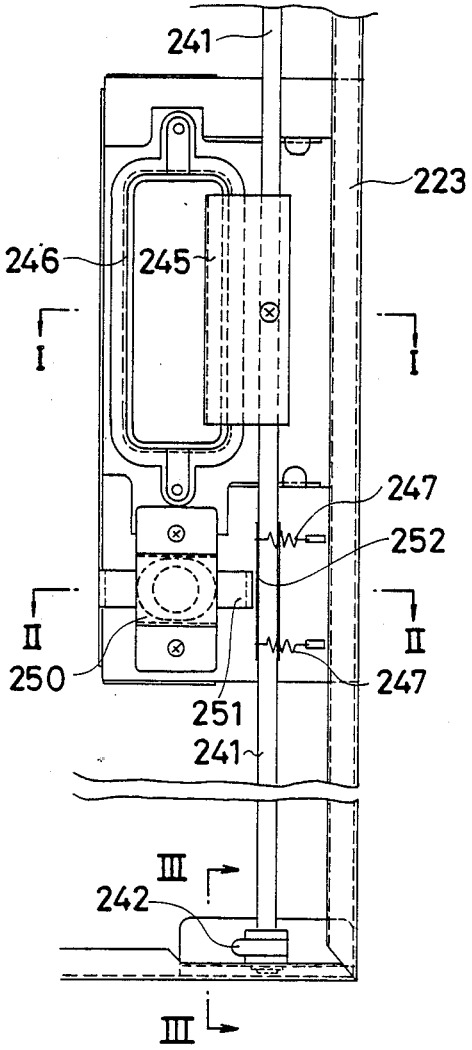
FIG. 27 is a rear elevation of the door in FIG. 24.
Figure 28:
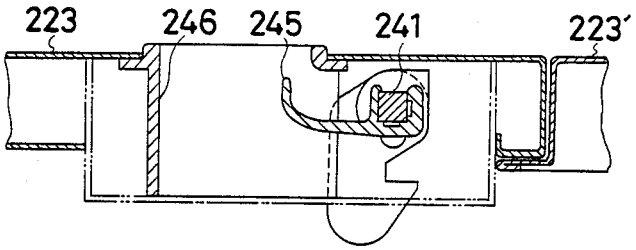
FIG. 28 is a sectional view taken on line I—I of FIG. 27.
Figure 29:
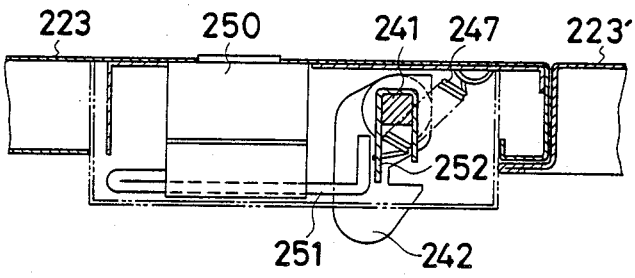
FIG. 29 is a sectional view taken on line II—II of FIG. 27.
Figure 30:
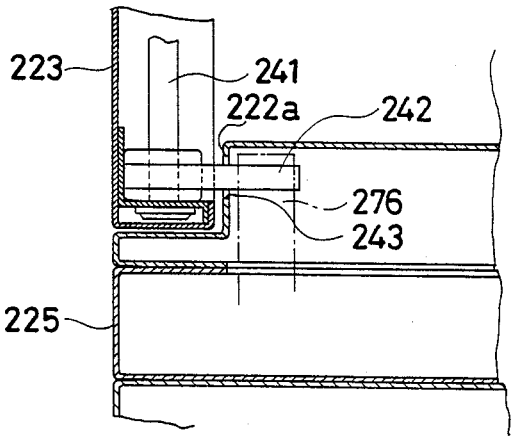
FIG. 30 is a sectional view taken on line III—III of FIG. 27.

Each drawer 226 disposed in multistage within the cabinet body 220 of the lower cabinet 221 is suspended ready for shifting longitudinally through a suspension rail which is not indicated therein. Then, FIG. 25 shows a locking motion for locking the drawers 226 in the lower cabinet 221 all at once, which comprises, as shown in FIGS. 25 and 26, a lock 231 mounted on a front panel of the lower cabinet body 220, a pair of link members 235, 235 coupled by a pin 233 so as to oscillate vertically concurrently with a cranked push member 232 turned eccentrically by operating the lock 231 with a key and supported on shafts 234, 234, and vertical rods 236, 236 engaging with noses of both the link members 235, 235.

Then, each drawer 226 cannot be drawn when the vertical rods 236 disposed longitudinally along insides of both the side plates **220*b* of the cabinet body 220** ascend or descend at a predetermined distance to have engaging pieces 237 mounted on the vertical rods 236 positioned in front of stoppers 238 provided projectingly outward on opposite sides of each drawer 226, but it can be drawn when the engaging pieces 237 come off the front of the stoppers 238 upward or downward, and a hole 240 is perforated in the top sheathing 220*a* of the lower cabinet body 220 over the push member 232.

On the other hand, in the upper cabinet 224, a latch rod 241 is installed turnably round a line of axis on the back of one door 223 of the closing doors 223, 223' of the upper cabinet 224, as shown in FIG. 26 to FIG. 30, latch claws 242, 242 are fixed on upper and lower ends of the latch rod 241 each, and the construction is such that when the door is closed, both the latch claws 242, 242 are fitted in engaging holes 243, 243 perforated in front of the upper and lower housing cases 222*a*, 222*b* of the upper cabinet body 222, thus keeping the door from being opened.

Then, a halfway portion of the latch rod 241 is coupled to a pull piece 245, the pull piece 245 is kept facing in a pull frame 246 provided on a front panel of the door 223, and the pull piece 245 is turned forward against the force of a spring 247, thus disengaging the latch claw 242 from the engaging hole 243.

The latch rod 241 then cannot be turned to locking by allowing a bar 251 of a lock 250 to contact with a locking piece 252 mounted on the latch rod 241.

Figure 31:
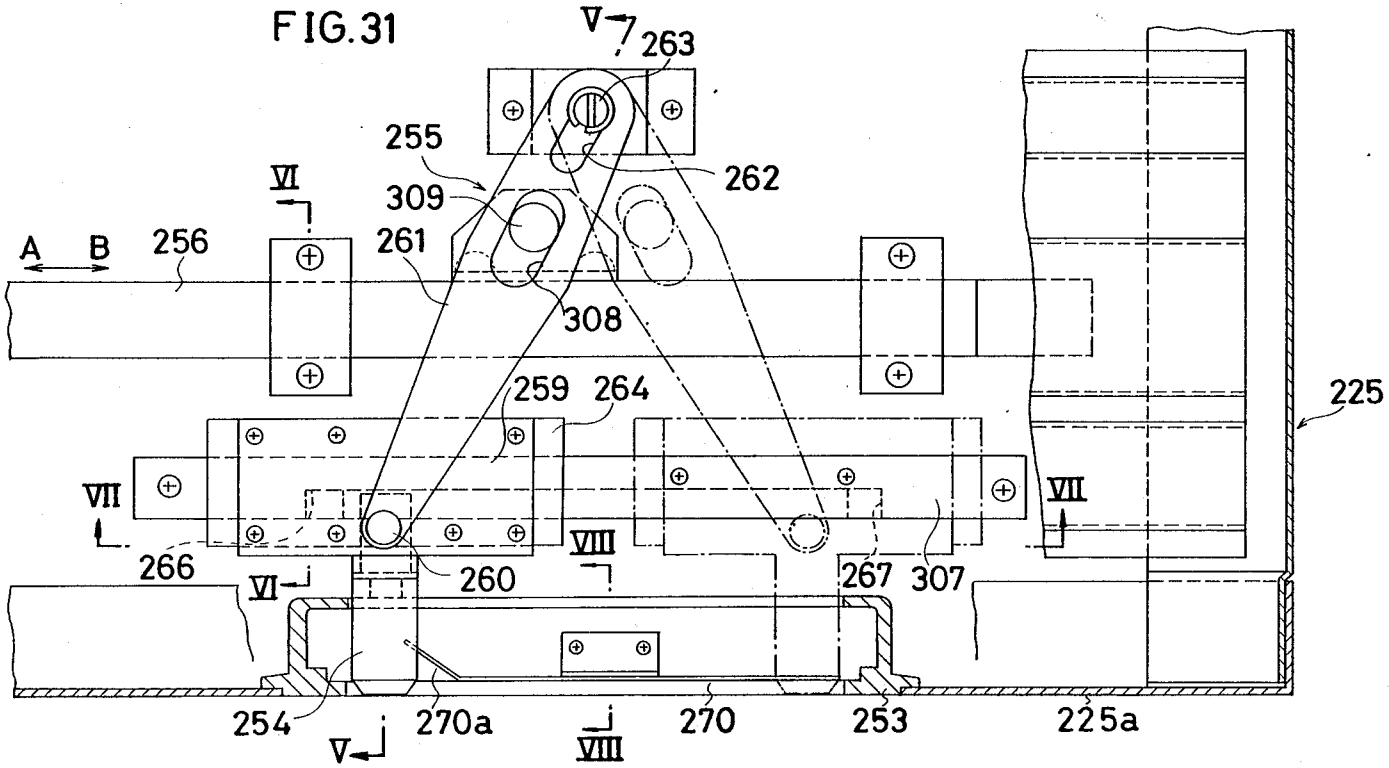
FIG. 31 is an enlarged plan sectional view taken on line IV—IV of FIG. 26.
Figure 32:
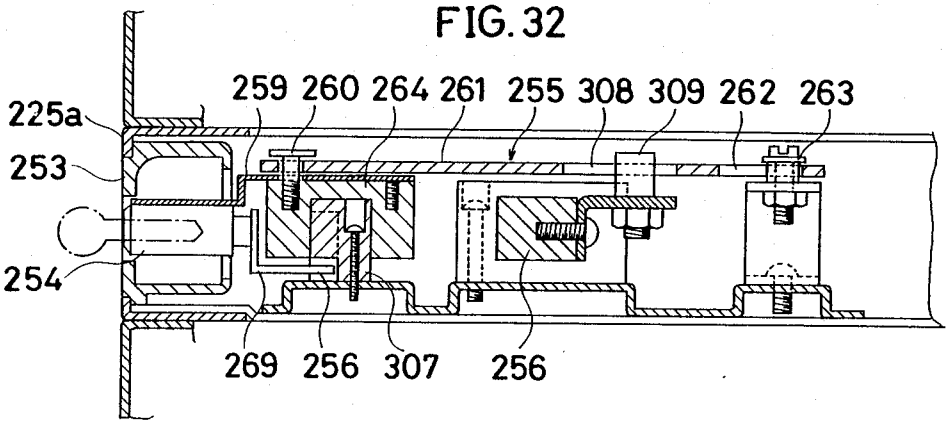
FIG. 32 is a sectional view taken on line V—V of FIG. 31.
Figure 39:
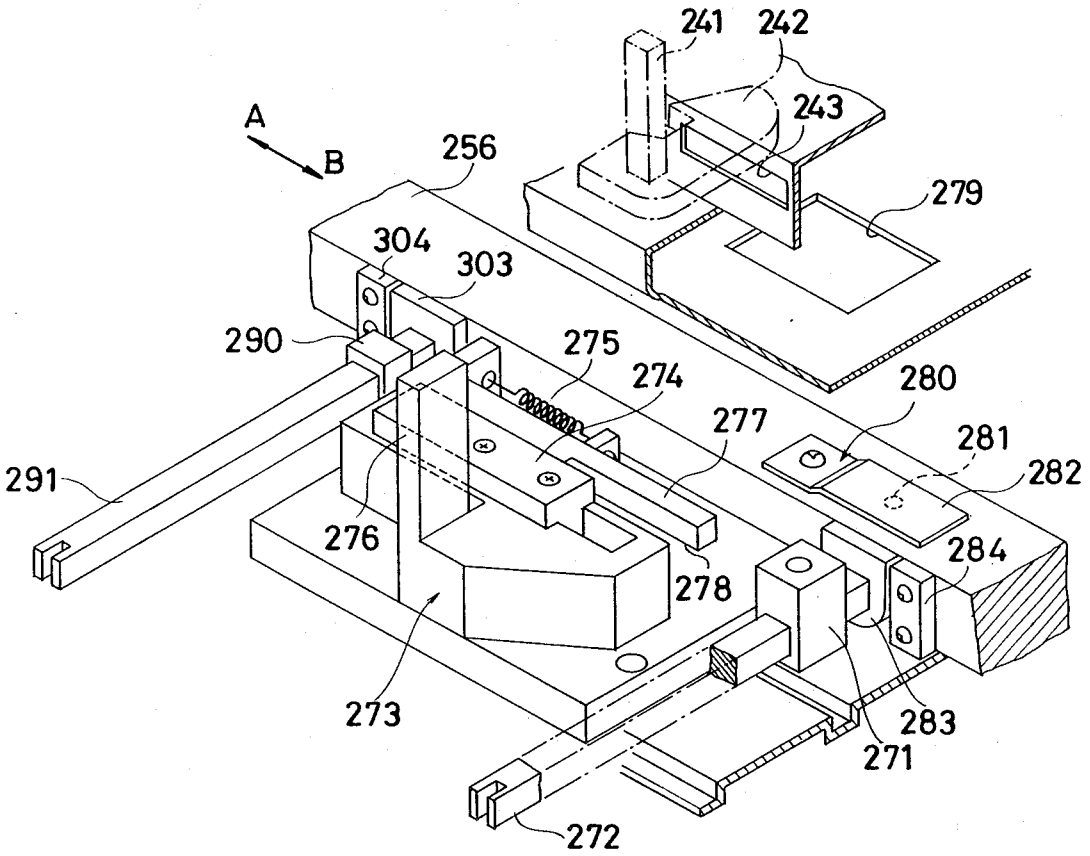
FIG. 39 is a perspective view of an upper interlocking motion.
Figure 47:
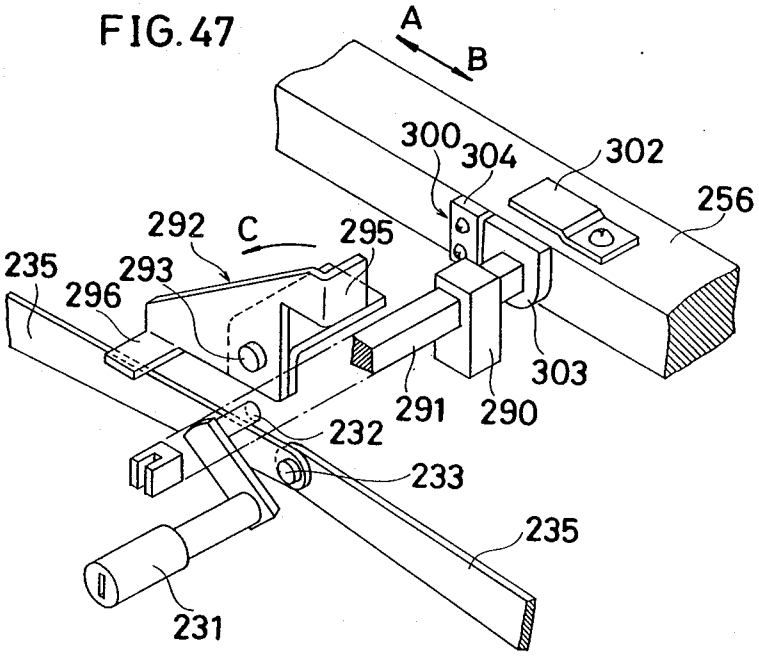
FIG. 47 is a perspective view of a lower interlocking motion.

Then, the all locking device 230 provided within the intermediate unit 225 is that for locking and unlocking concurrently the door 223 and the drawer 226 in both upper and lower cabinets 224, 221, which comprises, as shown in FIG. 31 and FIG. 32, a cylinder lock 254 capable of reciprocating horizontally which is inserted in a transverse operating frame 253 fitted in an elongated aperture perforated transversely in a front panel 225*a* of the intermediate unit 225, a transverse actuating rod 256 provided movably left and right through an interlocking mechanism 255 linking with the cylinder lock 254, an upper interlocking mechanism shown in FIG. 39 which is relevant to the latch claw 242 in the upper cabinet 224 and a lower interlocking mechanism shown in FIG. 47 which is relevant to the link member 235 of the locking motion in the lower cabinet.

Both the upper and lower interlocking mechanisms are mounted on the actuating rod 256, and in that for which both the upper and lower cabinets 224, 221 are provided plurally side by side, the transverse actuating rods 256 in the intermediate unit 225 are put together longitudinally through a coupling piece 257 and screws 258, and the upper and lower interlocking mechanisms are provided on each actuating rod 256.

Figure 34:
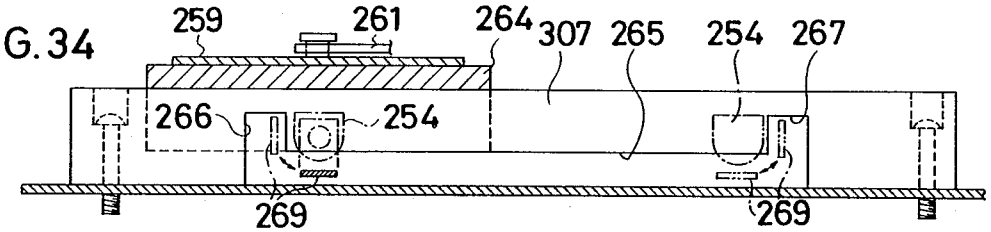
FIG. 34 is a sectional view taken on line VII—VII of FIG. 31.
Figure 33:
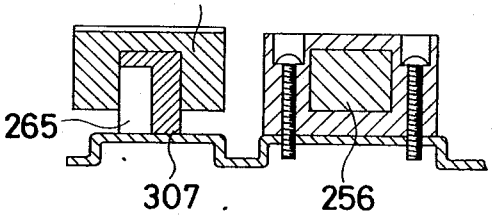
FIG. 33 is a sectional view taken on line VI—VI of FIG. 31.

As shown in FIG. 31 and FIG. 32, a structure of the interlocking mechanism 255 with the cylinder lock 254 and the actuating rod 256 is such that an interlocking arm 261 coupled by a spindle 260 through a mounting piece 259 extending rearward from the cylinder lock 254 has its rear end installed through a support shaft 263 fitted in an elongated groove 262, a slider 264 to which the spindle 260 is mounted is mounted slidably on a guide 307 disposed in parallel with the actuating rod 256 on a front side of the actuating rod 256 as shown in FIG. 33, and the actuating rod 256 is reciprocated in a locking direction (as indicated by an arrow A in the drawing) and a non-locking direction (as indicated by an arrow B) through a guide pin 309 engaging slidably with an elongated groove 308 provided longitudinally halfway of the interlocking arm 261. Then, locking recesses 266, 267 are formed on the guide 307 apart horizontally each other at a predetermined distance within the elongated groove 265 as shown in FIG. 34, and when the cylinder lock 254 shifts at a predetermined distance, a cranked locking piece 269 mounted on lock shafts 268 turned 90 degrees each almost on opposite sides, as shown in FIG. 35, by key operation to the cylinder lock 254 is fitted and locked in the locking recess 266 or 267, thus a position of the cylinder lock 254 is fixed, and both the upper and lower interlocking mechanisms which will be described hereinlater can be retained in a locking state or non-locking state.

Figure 35:
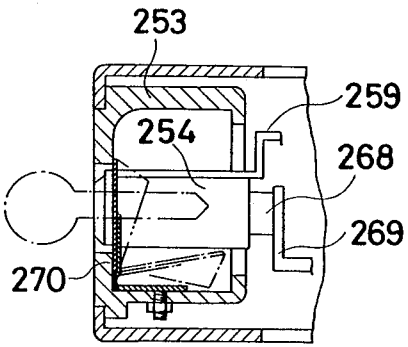
FIG. 35 is a sectional view taken on line VIII—VIII of FIG. 31.
Figure 36:
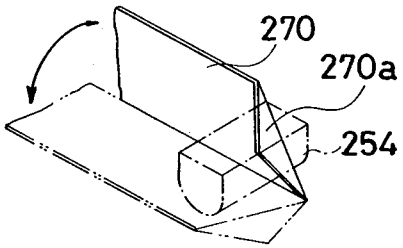
FIG. 36 is a perspective view of a cover plate viewed from a rear side.

Then, a cover plate 270 energized ahead in the operating frame 253 functions to block up an inside portion of the elongated groove of the operating frame 253 when the cylinder lock 254 shifts to the locking position (as indicated by a full line in FIG. 31), and as shown in FIG. 35, the cover plate 270 has a lower end pivoted so that the upper end falls inward of the intermediate unit 225, and a guide inclined plate 270*a* is provided on the left end of the cover plate 270 so that the cover plate 270 falls rearward when the cylinder lock 254 shifts rightward as shown in FIG. 36.

Figure 37:
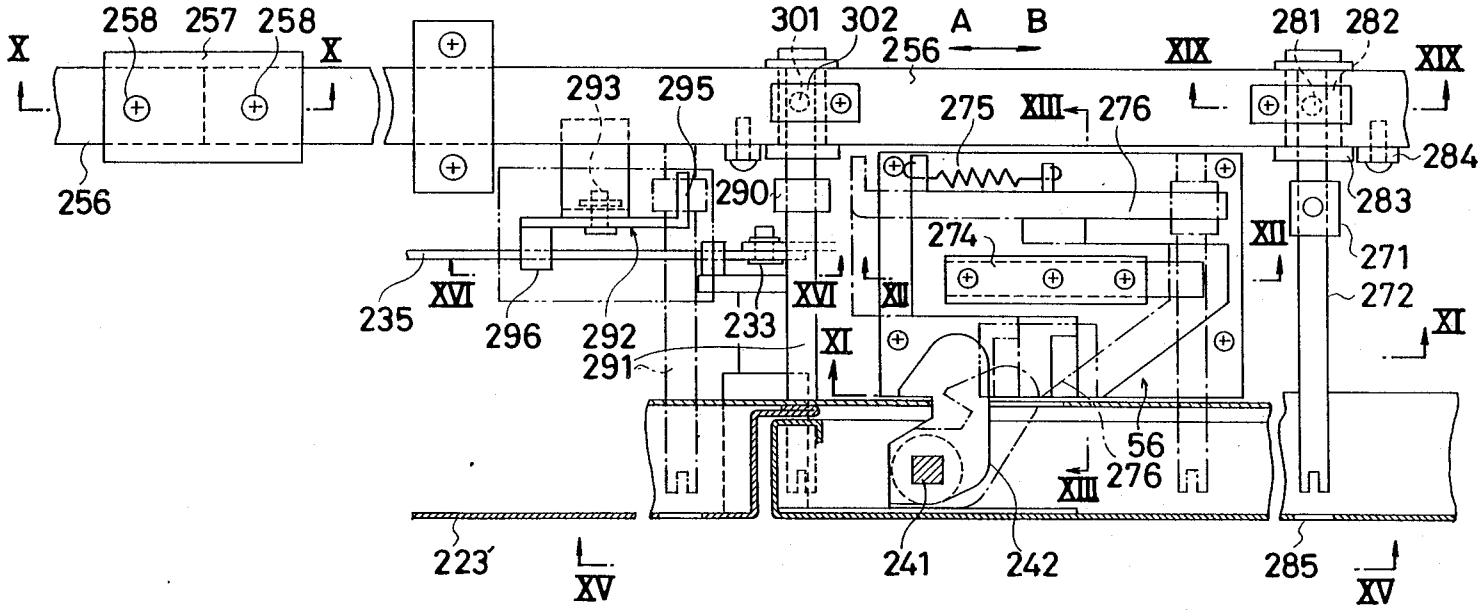
FIG. 37 is an enlarged plan sectional view taken on line IX—IX of FIG. 26.

Referring next to a structure of the upper interlocking mechanism to the upper cabinet 224, a reference character 271 in FIG. 37 and FIG. 39 denotes an upper cam fixed on a shaft 272 projecting forward from the actuating rod 256, and the upper cam 271 pushes and shifts an upper actuating member 273 described hereinlater in a locking direction (as indicated by an arrow A) as erected, thereby holding the latch claw 242 in a locked state.

The reference numeral 273 denotes an upper actuating member for locking the latch claw 242 of the closing door 223 in the upper cabinet 224 by pushing it on the back, the upper actuating member 273 is disposed slidably both left and right along a guide 274 in the intermediate unit 225, and when the actuating rod 256 shifts in a non-locking direction (as indicated by an arrow B), a push element 276 projecting upward in the upper actuating member 273 is energized in the direction detached from a back of the latch claw 242 on a force of a spring 275 provided between the intermediate unit 225 and the upper actuating member 27.

Figure 40:
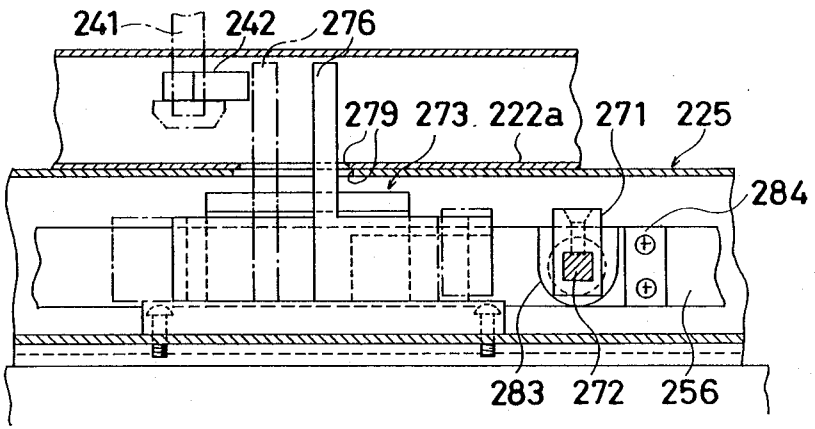
FIG. 40 is a sectional view taken on line XI—XI of FIG. 37.

In this case, the push element 276 in the upper actuating member 273 faces on the back of the latch claw 242 through a hole 279 perforated in the top sheathing of the intermediate unit 225 and the lower housing case 222*a* in the upper cabinet 224 as shown in FIG. 40.

Then, an upper lock inhibition selecting means 280 for selecting inhibition of a lock of the closing door 223 for one or more of the upper cabinets 224 . . . arranged in plurality s provided on the upper cam 271 mounted on the actuating rod 256 through the shaft 272 and the upper actuating member 273 shifted thereby.

Figure 43:
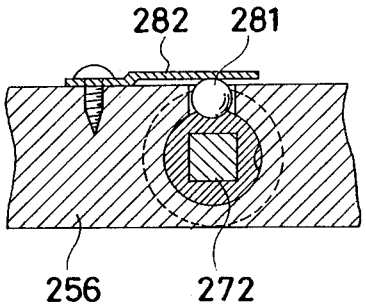
FIG. 43 is a sectional view taken on line XIV—XIV of FIG. 38.
Figure 41:
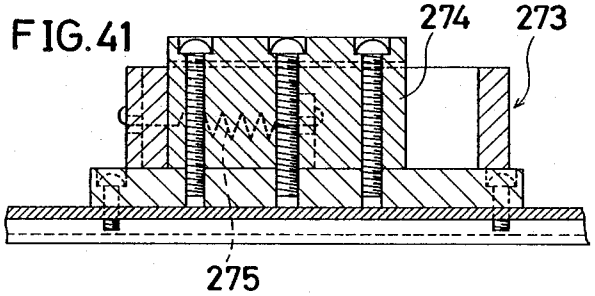
FIG. 41 is a sectional view taken on line XII—XII of FIG. 37.
Figure 44:
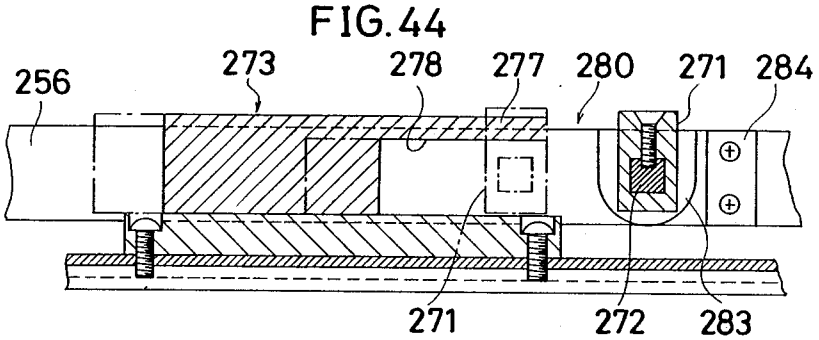
FIG. 44 is an explanatory drawing of function when an upper cam is raised.
Figure 45:
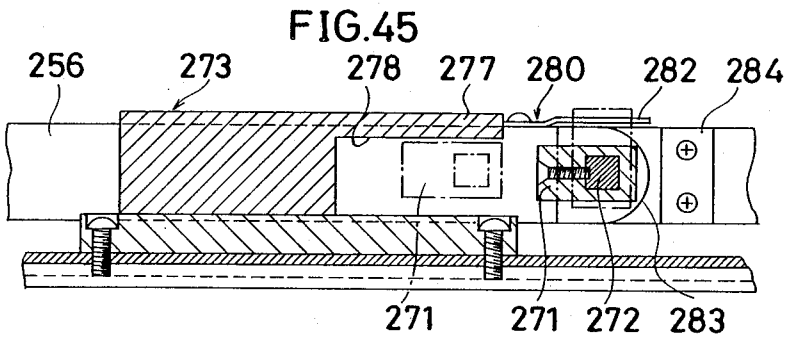
FIG. 45 is an explanatory drawing of function when the upper is turned down.
Figure 42:
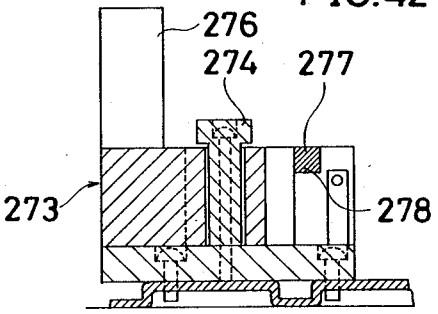
FIG. 42 is a sectional view taken on line XIII—XIII of FIG. 37.

That is, the shaft 272 installed turnably on the actuating rod 256 has the base portion pushed by positioning means consisting of a ball 281 and a leaf spring 282 as shown in FIG. 43 so as to select the state wherein the upper cam 271 turns 90 degrees to stand up or fall crosswise. Then, a contact piece 277 coming in contact with a side of the shaft 272 with the upper cam 271 standing up as shown in FIG. 44 is provided on the upper actuating member 273, a passage groove 278 is formed on a lower side of the contact piece 277, and thus when the actuating rod 256 shifts in the locking direction (as indicated by an arrow A) with the upper cam 271 falling crosswise as shown in FIG. 45, the upper cam 271 is fittable in the passage groove 278 along a lower side of the contact piece 277, and if the actuating rod 256 shifts in the locking direction, the upper actuating member 273 corresponding to a portion of the upper cam 271 will never be shifted in the locking direction, thus inhibiting a lock of the closing door 223 on the portion (as indicated by a one-dot line in FIG. 45). Then, when the upper cam 271 pushes the contact piece 277 in the upper actuating member 273 as standing up, the upper cam 271 turns arbitrarily counter to the pushing direction for a moment around the shaft 272, therefore a side of a collar 283 U-shaped in front which is mounted on the shaft 272 comes in contact with a stopper part 284 in front of the actuating rod 256, thus preventing the shaft 272 from turning.

Figure 46:
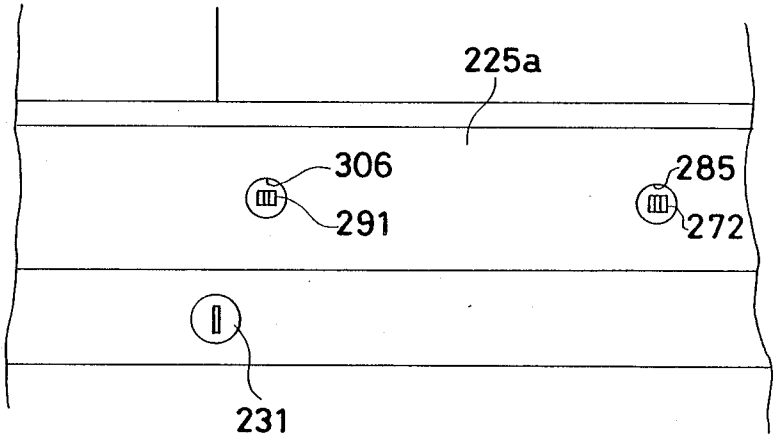
FIG. 46 is a sectional view taken on line XV—XV of FIG. 37.
Figure 38:
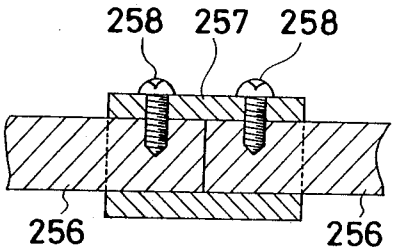
FIG. 38 is a sectional view taken on line X—X of FIG. 37.

Then, as shown in FIG. 37 and FIG. 46, in the state where the shaft 272 is shifted in the non-locking direction, a front end of the shaft 272 is positioned inward of an operating hole 285 perforated in the front panel 225*a* in the intermediate unit 225, and from turning the shaft 272 right or left round the line of axis by a screwdriver or the like which is inserted from the operating hole 285, the upper cam 271 stands up to provide a position ready for locking or the upper cam 271 falls crosswise to provide a position not for locking, and a posture of the shaft 272 at the position ready for locking cannot be changed when the actuating rod 256 is shifted in the locking direction (as indicated by an arrow A), the closing doors 223, 223' in a locked state at the cabinet body portion can no more be opened, thus providing against a theft.

Next, the lower interlocking mechanism to the lower cabinet 226 will be described with reference to FIG. 37, FIG. 47 to FIG. 50.

In the drawings, a reference numeral 290 denotes a lower cam fixed on a shaft 291 projecting forward from the actuating rod 256, and the lower cam 290 functions to push and turn a later-described lower actuating member 292 in a locking direction (as indicated by an arrow C) as standing up, thereby retaining the link members 235, 235 of a locking mechanism for locking all the drawers 226 . . . in the lower cabinet 221 concurrently in a locked state. The lower actuating member 292 is mounted turnably on a pivot 293 supported on the top sheathing 220*a* and others of the cabinet body 220 in the lower cabinet, further the lower actuating member 292 can be installed detachably to the arbitrary lower cabinet body 220, and a passage hole 294 is perforated in a lower surface of the intermediate unit 225 at a corresponding portion so that the lower actuating member 292 can be installed across the top sheathing 220*a*.

Figure 48:
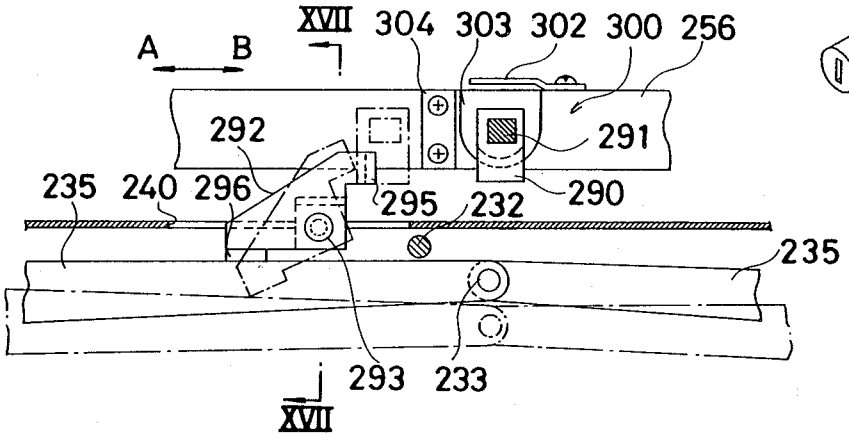
FIG. 48 is a sectional view taken on line XVI—XVI of FIG. 37.
Figure 49:
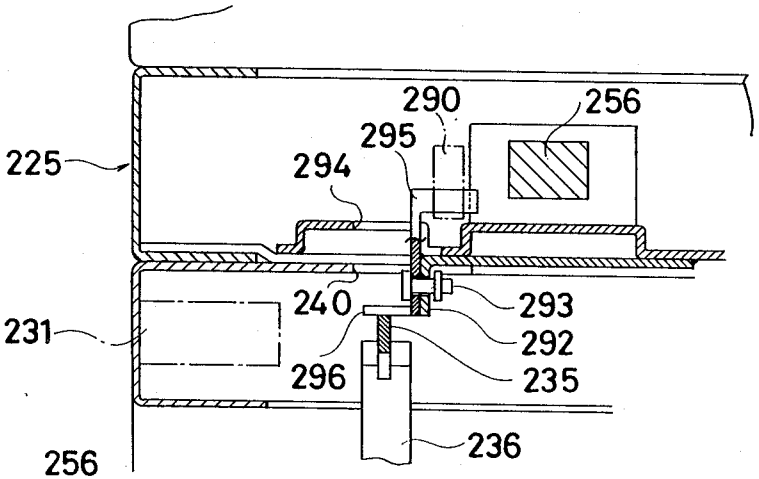
FIG. 49 is a sectional view taken on line XVII—XVII of FIG. 48.

Then, at the time when the actuating rod 256 is shifted in a locking direction (as indicated by an arrow A), if an upper end contact portion 295 in the lower actuating member 292 pushed to the lower cam 290 is turned in the direction C, a push portion 296 in the lower actuating member 292 pushes a top halfway portion of the one link member 235 downward to lift the vertical rod 236 of FIG. 25 as indicated by one-dot chain line in FIG. 48, therefore all the drawers 226 in the lower cabinet 221 can be locked concurrently.

Then, the lower actuating member 292 is energized on spring so that the upper end contact portion 295 may return counter to the arrow C.

Further, a so-called lock inhibition means 300 for inhibiting selectively a locking operation of the all locking device 230 to one or more of the lower cabinets 221 . . . according to a selection on whether or not the lower actuating member 292 of a corresponding portion is ready for contacting is provided on the shaft 291 provided with the lower cam 290 in the actuating rod 256. That is, the shaft 291 installed turnablY on the actuating rod 256 has its base portion pushed by positioning means consisting of a ball 301, a leaf spring 302 and others so that the lower cam 290 may be selected to a state where it stands downward and that in which it falls crosswise from turning at 90 degrees.

Figure 50:
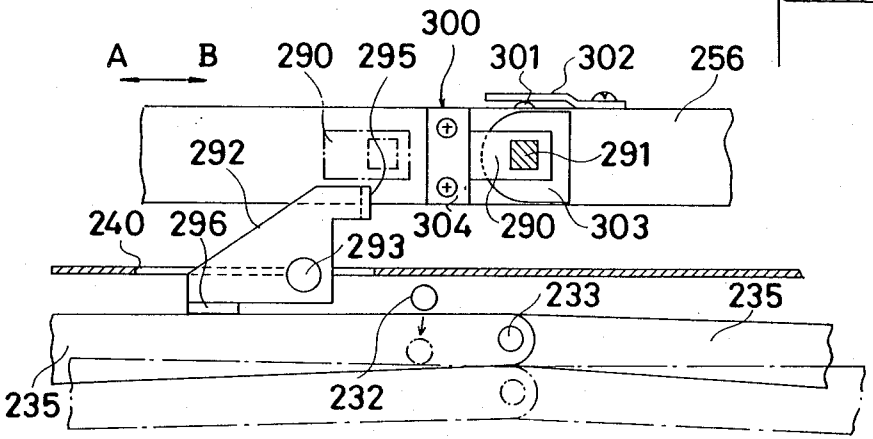
FIG. 50 is an explanatory drawing of function when a lower cam is turned down.

Then, as shown in FIG. 50, where the lower cam 290 falls crosswise, the lower cam 290 is capable of passing transversely over the upper end contact portion 295 in the lower actuating member 292, but where the lower cam 290 stands long downwardly, the lower cam 290 and the lower actuating member 292 are formed and disposed so that the lower cam 290 may come in contact with a side of the upper end contact portion 295 as shown in FIG. 48.

To prevent the lower cam 290 pushing the upper end contact portion 295 in the lower actuating member 292 as standing up from turning arbitrarily in the direction counter to that in which the lower cam 290 pushes as mentioned above, a side of a collar 303 U-shaped in front which is mounted on the shaft 291 comes in contact with the stopper 274 in front of the actuating rod 256, and thus the shaft 291 can be prevented from turning.

Further, as in the case of upper lock inhibition means 280, with the shaft 291 shifted in non-locking direction as shown in FIG. 46, a front end of the shaft 291 is position inward of an operating hole 306 perforated in the front panel 225*a* in the intermediate unit 225, and from turning the shaft 291 right or left round the line of axis by a screwdriver or the like which is inserted from the operating hole 306, the lower cam 290 stands lengthwise downwardly to provide a position ready for locking or the lower cam 290 falls crosswise to provide a position not for locking, and a posture of the shaft 291 at the position ready for locking cannot be changed when the actuating rod 256 is shifted in the locking direction (as indicated by the arrow A), the drawers 226 in an all locked state at the cabinet body portion can no more be operated, thus providing against a theft.

Then, when constructing the lower cabinet 221 as a closing door type, a push part projecting downward of the lower actuating member in the lower interlocking mechanism which shifts crosswise according as the actuating rod 256 shifts crosswise in the locking direction may be provided so as to push a back of the clatch claw 242 to the upper housing case in the lower cabinet 221, and when constructing the upper cabinet 224 as a multistage drawer type, the construction may be such that the push part of a turning type actuating member in the upper interlocking mechanism which turns according as the actuating rod shifts crosswise in the locking direction will push a lower surface of the link member so as to operate for all locking when the link member of the all locking mechanism for drawers in the upper cabinet 224 is pushed from below to turn, and in case both the upper and lower cabinets 224, 221 are constructed all as closing door type or multistage drawer type, the aforementioned constructions may be utilized.

Then, in case a spring-up turning type closing door is provided on a front portion of the front open drawer provided slidably back and forth in the cabinet body, and the closing door is locked, the aforementioned all locking device 230 is also applicable.

Further, the all locking device 230 is provided not only in the intermediate unit 225 separate from the upper and lower cabinets as described in the embodiment but also in the upper housing case of the cabinet body 220 in the lower cabinet 221, however, when it is provided in the intermediate unit 225 as described, housing case portions of the cabinets 221, 224 can be formed same in height as a normal one, and a form of the container part may be unified.

What is claimed is:

1. A wall cabinet held between a floor and a ceiling, said wall cabinet comprising:

a container part including various cabinets, said container part having upper and lower base plates;

a first adjustable means positioned at said lower base plate for adjusting a distance between said lower base plate and the floor;

an under frame extending from a circumference of said lower base plate toward the floor for covering said first adjustable means;

a second adjustable means positioned at said upper base plate for adjusting a distance between said upper base plate and said ceiling, said second adjustable means having upper and lower top frames slidably interposed, and a locking member for locking said upper and lower top frames in order to conform with the distance between said upper base plate and said ceiling.

2. A wall cabinet as defined in claim 1, further comprising a guide rail is provided on opposite side edges of the top of the container part; and a cover formed to have three closed and one open side and fitted slidably along said guide rail such that said cover is located between said upper base plate and the top of the container part.

3. The wall cabinet as defined in claim 1, said container part having a plurality of cabinets arranged therein, wherein a shelf stand is provided and formed to the full width and depth of the container part and formed in height so as to occupy the space between the top of said container part and the bottom of said lower top frame.

4. The wall cabinet as defined in claim 1, said container part comprising a plurality of cabinets stacked one on top of the other, wherein locking means are provided for concurrently locking said cabinets in the said container part.

5. The wall cabinet as defined in claim 4, wherein cooperating means are provided between cabinets paired vertically such that said cooperating means allows said locking means to concurrently lock each said vertically paired set of cabinets.

6. The wall cabinet as defined in claim 5, said plurality of cabinets comprising a first cabinet including a plurality of drawers and a second cabinet including a closing door, wherein locking means for locking closed the drawers and the closing door comprises a cylinder lock connected to said cooperating means via an acutating rod disposed horizontally so as to move left or right horizontally in order to operate said cooperating means, and said cooperating means comprises an interlocking mechanism connected to said actuating rod. such that horizontal movement of said actuating rod actuates said interlocking mechanism thereby locking closed the drawers and the closing door.

7. The wall cabinet as defined in claim 5, said container part comprising two closing door cabinets paired and positioned one on top of the other, wherein a latch claw engageable with said container part is provided for locking closed both closing doors of each cabinet, said locking means comprises a cylinder lock connected to said cooperating means via an actuating rod connected so as to move left and right in order to actuate said cooperating means, and said cooperating means comprises an interlocking mechanism connected so as to cooperate with the left and right horizontal movement of said acutating rod thereby actuating said latch claw for both said closing door cabinets.

8. The wall cabinet as defined in claim 4, said vertically paired set of cabinets having a the first cabinet being a plurality of door and the second cabinet being a closing drawer, wherein locking means for locking closed the drawers and the closing door comprises a cylinder lock connected to said cooperating means via an actuating rod disposed horizontally so as to move left or right horizontally in order to operate said cooperating means, and said cooperating means comprises an interlocking mechanism connected to said actuating rod such that horizontal movement of said actuating rod actuates said interlocking mechanism thereby locking closed the drawers and the closing door.

9. A wall cabinet as defined in claim 1, wherein said second adjusting means comprises at least one adjusting screw for adjusting the distance between the upper base plate and the ceiling.

10. A wall cabinet as defined in claim 1, wherein said second adjusting means comprises at least one locking groove interacting with an externally projecting claw and for adjusting the distance between the upper base plate and the ceiling.

* * * * *